US012246886B2

(12) United States Patent
Li

(10) Patent No.: US 12,246,886 B2
(45) Date of Patent: Mar. 11, 2025

(54) CONTAINER LID

(71) Applicant: HANGZHOU GREAT STAR INDUSTRIAL CO., LTD., Hangzhou (CN)

(72) Inventor: Yueming Li, Hangzhou (CN)

(73) Assignee: HANGZHOU GREAT STAR INDUSTRIAL CO., LTD., Hangzhou (CN)

( * ) Notice: Subject to any disclaimer, the term of this patent is extended or adjusted under 35 U.S.C. 154(b) by 0 days.

(21) Appl. No.: 18/014,147

(22) PCT Filed: Aug. 10, 2022

(86) PCT No.: PCT/CN2022/111331
§ 371 (c)(1),
(2) Date: Dec. 31, 2022

(87) PCT Pub. No.: WO2023/173665
PCT Pub. Date: Sep. 21, 2023

(65) Prior Publication Data

US 2024/0092543 A1 Mar. 21, 2024

(30) Foreign Application Priority Data

Mar. 17, 2022 (CN) ..... 202220580699.3
Jun. 29, 2022 (CN) ..... 202221657339.5

(51) Int. Cl.
*B65D 47/28* (2006.01)
*B65D 43/02* (2006.01)
*B65D 47/08* (2006.01)

(52) U.S. Cl.
CPC ..... *B65D 47/286* (2013.01); *B65D 43/0202* (2013.01); *B65D 47/0857* (2013.01);
(Continued)

(58) Field of Classification Search
CPC ..... B65D 47/286; B65D 43/0202; B65D 47/0857; B65D 2543/00046; B65D 2543/00092
(Continued)

(56) References Cited

U.S. PATENT DOCUMENTS 10,183,789 B1 * 1/2019 Lin ..... A47G 19/2272
11,814,223 B1 * 11/2023 Seiders ..... B65D 47/286
(Continued)

FOREIGN PATENT DOCUMENTS

CN 1242902 A 1/2000
CN 104890996 A 9/2015
(Continued)

OTHER PUBLICATIONS

International Search Report of PCT/CN2022/111331.

*Primary Examiner* — J. Gregory Pickett
*Assistant Examiner* — Niki M Eloshway

(57) ABSTRACT

A container lid is provided. The container lid comprises a lid body and an outlet lid. The lid body is provided with a liquid outlet; and the outlet lid is movably connected to the container lid, and configured to define a closed state, an opened state, and a detachable state of the container lid. When the container lid is in the closed state, the liquid outlet is closed, when the container lid is in the opened state, the liquid outlet is opened, and when the container lid is in the detachable state, the outlet lid is separated from the lid body.

3 Claims, 23 Drawing Sheets

(52) U.S. Cl.
CPC ..... *B65D 2543/00046* (2013.01); *B65D 2543/00092* (2013.01)

(58) Field of Classification Search
USPC ..... 220/714, 713, 254.3
See application file for complete search history.

(56) References Cited

U.S. PATENT DOCUMENTS

| | | | | |
|---|---|---|---|---|
| 2005/0258180 | A1 | 11/2005 | Lown | |
| 2006/0201945 | A1* | 9/2006 | Tedford | B65D 47/286 229/404 |
| 2014/0305941 | A1* | 10/2014 | Hodge | B65D 47/286 220/812 |
| 2017/0066573 | A1* | 3/2017 | Karussi | B65D 81/3869 |
| 2017/0253392 | A1 | 9/2017 | Bann | |
| 2020/0055645 | A1 | 2/2020 | Lane | |
| 2020/0231345 | A1* | 7/2020 | Lane | B65D 47/248 |
| 2020/0391910 | A1* | 12/2020 | Pinelli | A47G 19/2272 |
| 2021/0047089 | A1* | 2/2021 | Seiders | B65D 47/286 |
| 2022/0112011 | A1* | 4/2022 | McNamara | B65D 51/18 |
| 2023/0063031 | A1* | 3/2023 | Ni | B65D 51/18 |
| 2023/0159235 | A1* | 5/2023 | Gillespie | B65D 47/286 220/254.1 |
| 2023/0211937 | A1* | 7/2023 | Dunlap | B65D 81/2038 222/522 |
| 2023/0248165 | A1* | 8/2023 | Lin | A47G 19/2266 220/713 |

FOREIGN PATENT DOCUMENTS

| | | | | |
|---|---|---|---|---|
| CN | 106061856 | A | 10/2016 | |
| CN | 108669963 | A | 10/2018 | |
| CN | 211066051 | U | 7/2020 | |
| CN | 215324374 | U | 12/2021 | |
| CN | 114572551 | A * | 6/2022 | A47G 19/2272 |
| EP | 2915761 | A1 * | 9/2015 | A47G 19/2272 |
| KR | 102048769 | B1 * | 11/2019 | |

* cited by examiner

CONTAINER LID

CROSS-REFERENCE TO RELATED APPLICATIONS

This application is a National Stage application of International Application No. PCT/CN2022/111331 filed on Aug. 10, 2022, which claims all benefits accruing from China Patent Application Nos. 202220580699.3, filed on Mar. 17, 2022, and titled "LID AND CONTAINER THEREOF", and 202221657339.5, filed on Jun. 29, 2022, and titled "CONTAINER AND LID THEREOF", in the China National Intellectual Property Administration, the contents of which are hereby incorporated by reference.

TECHNICAL FIELD

The present disclosure relates to the field of containers, in particular, to a container lid.

BACKGROUND

Currently, a class of portable containers having a container body and a lid thereof are popular in the market. In addition to a lid body provided with a liquid outlet, a container lid of the container further includes an outlet lid movably mounted on the lid body. The outlet lid can open or seal the liquid outlet by moving along a predetermined track on the lid body.

The portable containers can not only be used to store water, but in some occasions, users also use the containers to store liquids such as tea, coffee, and the like. After the container is used for a long time, dirt may deposit on the liquid outlet, the lid body and the outlet lid. Due to the limitation of installation structure of the outlet lid and the lid body, the container lid may be difficult to clean, and it is difficult or even impossible to clean the container lid thoroughly.

SUMMARY

An advantage of the present disclosure is providing a container lid, which not only can prevent the outlet lid from being lost, but also can be easily detached for cleaning Another advantage of the present disclosure is providing a container lid. In an embodiment of the present disclosure, the container lid can be freely switched between a closed state, a fixed opened state and a detachably opened state, so as to meet different application scenes and different requirements.

Another advantage of the present disclosure is providing a container lid. In an embodiment of the present disclosure, a state of the container lid can be switched by pivoting the outlet lid. When the container lid is in the detachably opened state, the outlet lid can be quickly detached from the container lid by rotating the outlet lid, so as to facilitate cleaning the outlet lid.

Another advantage of the present disclosure is providing a container lid. In an embodiment of the present disclosure, a deformation capability of a pivot portion of the outlet lid can be improved by disposing a groove, so that the outlet lid can be not only stably pivotally connected to the container lid, but also easily detachable from the container lid.

Another advantage of the present disclosure is providing a container lid. In an embodiment of the present disclosure, the container lid can be stably kept in the closed state via latching between the outlet lid and the peripheral portion of the lid body, to prevent a liquid in the container from leaking. And the container lid can further be stably kept in the fixed opened state via latching between the outlet lid and the peripheral portion of the lid body, to prevent the outlet lid from pivoting to disturb using.

Another advantage of the present disclosure is providing a container lid. In an embodiment of the present disclosure, the container lid is provided with a detaching groove at one side, which ensures that the outlet lid can only be disassembled while rotating towards a direction a liquid flows out, so as to prevent the outlet lid from being accidentally detached by mis-operation.

Another advantage of the present disclosure is providing a container lid. In order to achieve the above advantages, it is not necessary to apply expensive materials or complex structures in the present disclosure. Thus, the present disclosure provides a successful and effective technical solution, in which not only a simple container lid is provided, but also practicability and reliability of the container lid is improved.

In view of above, in order to achieve at least one advantage or object of the present disclosure, the present disclosure provides a container lid. The container lid includes a lid body and an outlet lid. The lid body is provided with a liquid outlet. The outlet lid is movably connected to the lid body, and configured to define a closed state, an opened state, and a detachable state of the container lid. When the container lid is in the closed state, the liquid outlet is closed. When the container lid is in the opened state, the liquid outlet is opened. When the container lid is in the detachable state, the outlet lid is separated from the lid body.

In some embodiments, the lid body is provided with a first preset path and a second preset path, and the outlet lid is capable of switching between the first preset path and the second preset path. The outlet lid is capable of moving along the first preset path to make the container lid switch between the closed state and the opened state. The outlet lid is capable of moving along the second preset path to make the container lid switch between the closed state and the detachable state or between the opened state and the detachable state.

Therefore, a movement process of detaching the outlet lid from the lid body is separated from a movement process of opening or closing the liquid outlet on the lid body via the outlet lid, so that the outlet lid will not separate from the lid body while switching the container lid between the opened state and the closed state, and the container lid can be normally used.

In some embodiments, the first preset path includes a sliding channel, and the second preset path includes an opening. The sliding channel is in communication with the opening. The container lid further includes a sliding block fixed to the outlet lid and slidably matched with the sliding channel. The sliding channel is configured to lead the outlet lid to move along a surface of the opening, and the opening is configured for allowing the outlet lid to be disassembled from the lid body.

Therefore, when the outlet lid moves along the sliding channel, the container lid can be switched between the opened state and the closed state. When the outlet lid reaches the opening, the outlet lid can be disassembled and separated from the lid body. That is, a movable connecting area and a detachable separating area of the outlet lid on the lid body are independently and precisely disposed.

In some embodiments, the sliding block is fixed on a side of the outlet lid near the lid body. The sliding block includes a first end near the outlet lid and a second end away from the outlet lid. A size of the first end along a width direction of the sliding channel is smaller than a size of the second end along the width direction of the sliding channel. The sliding channel comprises a first inner wall and a second inner wall opposite to the first inner wall along the width direction thereof. A projection of the sliding block on a plane perpendicular to the first preset path is substantially the same with that of the first inner wall and second inner wall on the plane perpendicular to the first preset path, and the first inner wall and/or the second inner wall are configured to limit the sliding block to prevent the sliding block from departing from the sliding channel.

Therefore, the first inner wall and/or the second inner wall can have a better limiting effect when limiting the sliding block and the outlet lid. The outlet lid can be movably and reliably connected to the lid body. The container lid can have a simple structure and be easy to process.

In some embodiments, a projection of the sliding block on a plane perpendicular to the first preset path is L-shaped.

Therefore, a sliding matching between the sliding block and the sliding channel can be reliable and smooth. The user can operate the outlet to open or close the container lid with littler labor without concern that the outlet lid may be detached from the lid body.

In some embodiments, a side of the lid body near the outlet lid is provided with a groove. The groove is in communication with the sliding channel and the opening. The lid body is provided with a limiting plate extending along the first preset path, and a sliding gap is defined between the limiting plate and a bottom surface of the sliding channel away from the outlet lid. The outlet lid is accommodated in the groove, the sliding block is slidably disposed in the sliding channel and is capable of extending into the sliding gap. The limiting plate is capable of limiting the sliding block to limit the outlet lid to prevent from departing from the groove.

Therefore, the limiting plate can reliably limit the sliding block and the outlet lid. Thus, in a process of switching the container lid between the closed state and the opened state, the limiting plate can prevent the sliding block from separating from the sliding gap, so as to prevent the outlet lid from accidently departing from the lid body.

In some embodiments, a side of the outlet lid towards the groove is provided with a first latching portion, and a bottom surface of the groove is provided with a second latching portion and a third latching portion, respectively. The first latching portion is capable of matching with the second latching portion to keep the container lid in the closed state, and the first latching portion is capable of matching with the third latching portion to keep the container lid in the opened state.

Therefore, when the user drinks a liquid, the outlet lid will not spontaneously move to close and seal the liquid outlet. In addition, when the container lid is in the closed state, the outlet lid will not spontaneously move to open the liquid outlet, so as to prevent water from leaking. Thus, the user's experience can be improved.

In some embodiments, the lid body is provided with a third preset path, and the third preset path includes an opened position, a closed position and a detachable position corresponding to the opened state, the closed state and the detachable state, respectively. The outlet lid is capable of moving along the third preset path, so as to make the container lid switch between the closed state and the opened state, or switch the container lid between the closed state and the detachable state or between the opened state and the detachable state.

Therefore, moving mode and moving path of the outlet lid relative to the lid body can be simpler, and can facilitate lowering operation difficulty of the user.

In some embodiments, the third preset path includes a sliding channel, a side of the outlet lid near the sliding channel is provided with an elastic protrusion. The lid body is provided with a first section and a second section connected to the first section. The sliding channel is disposed correspondingly to the first section, and a size of the first section along an elastic deformation direction of the elastic protrusion is greater than that of the second section. The outlet lid is capable of driving the elastic protrusion to move in the sliding channel, and the outlet lid is capable of driving the elastic protrusion to move from the first section to the second section. The elastic protrusion is capable of elastically deforming, so as to make the outlet lid separate from the lid body via the second section.

Therefore, when the elastic protrusion deforms under the action of the second section, the outlet lid can automatically separate from the sliding channel, so that the outlet lid can be more easily to be detached from the lid body and can be conveniently used and quickly detached.

In some embodiments, an end of the elastic protrusion near the lid body is provided with an inclined surface. The inclined surface is opposite to a bottom surface of the sliding channel and a sidewall of the sliding channel, and contacts with a sidewall edge of the second section.

Therefore, the sidewall edge of the second section can effectively apply force on the elastic protrusion, and the outlet lid and the lid body can be more quickly assembled to a container lid with less labor. In addition, since the inclined surface can avoid a sudden change of a force applied by the second section on the elastic protrusion, a risk of breakage of the elastic protrusion can be lowered.

In some embodiments, the outlet lid includes a first pin joint portion and a shielding portion. The shielding portion is fixed to an end of the first pin joint portion and extends along a radial direction of a cross section of the first pin joint portion, another end of the first pin joint portion away from the shielding portion is provided with a limiting protrusion extending along the radial direction of the cross section of the first pin joint portion. The lid body is provided with a pivot hole and an opening communicated with the pivot hole, and the first pin joint portion extends in and is connected to the pivot hole. A size of the opening matches with a size of the limiting protrusion. When the outlet lid is at the closed position, the shielding portion is sealed on the liquid outlet. When the outlet lid is at the opened position, the shielding portion gives way to the liquid outlet. When the outlet lid is at the detachable position, the limiting protrusion is corresponding to the opening.

Therefore, the outlet lid can be rotatably connected to the lid body via the first pin joint portion, so that the container lid can be more conveniently and easily opened and closed, and the assembly and disassembly between the outlet lid and the lid body can be more convenient.

In some embodiments, the outlet lid is detachably and pivotally connected to the lid body, and configured to open and seal the liquid outlet of the lid body. When the outlet lid pivots relative to the lid body, the container lid is able to switch between the closed state and the opened state. The opened state includes a detachable opened state.

In some embodiments, when the outlet lid is pivoted to make the container lid in the closed state, the outlet lid is near the liquid outlet to seal the liquid outlet. When the outlet lid is pivoted to make the container lid in the opened state, the outlet lid is away from the liquid outlet to open the liquid outlet. When the outlet lid is pivoted to make the container lid in the detachable opened state, the outlet lid is rotated to separate from the lid body.

In some embodiments, the outlet lid includes a pivot portion connected to the lid body and a sealing cover extending from the pivot portion along a radial direction of a cross section of the lid body. When the sealing cover of the outlet lid pivots around the pivot portion, the container lid can be switched between the closed state and the detachable opened state. When the container lid is in the detachable opened state, the pivot portion of the outlet lid is rotated around an end of the pivot portion to separate the outlet lid from the lid body.

In some embodiments, the lid body is further provided with a pair of pivot grooves and a detaching groove. The pair of pivot grooves are configured to match with two ends of the pivot portion, and the detaching groove is in communication with the pivot groove. The two ends of the pivot portion of the outlet lid are inserted in and pivotally connected to the pair of pivot grooves of the lid body, respectively. When the pivot portion of the outlet lid is rotated around the end of the pivot portion, another end of the pivot portion of the outlet lid is capable of sliding out of the pivot groove along the detaching groove.

In some embodiments, a bottom surface of the detaching grooves obliquely extend from groove bottoms of the pair of pivot grooves towards a notch of the pivot groove, so as to lead the pivot portion of the outlet lid to depart from the pair of pivot grooves.

In some embodiments, the pair of detaching grooves of the lid body match with the pair of pivot grooves, respectively, and two bottom surfaces of the pair detaching grooves extend towards each other from the corresponding pivot grooves, respectively.

In some embodiments, the pair detaching grooves of the lid body extend along a direction from the pivot grooves towards the liquid outlet.

In some embodiments, the sealing cover of the outlet lid is integrally formed with the pivot portion, and extends from the pivot portion, and the pivot portion of the outlet lid is provided with a deforming groove.

In some embodiments, the outlet lid further includes a flexible member and a sealing member. The flexible member is accommodated in the deforming groove of the pivot portion. The sealing member is disposed on the sealing cover and configured to seal the liquid outlet of the lid body when the container lid is in the closed state.

In some embodiments, the pivot portion includes a pair of pivot chambers connected to the sealing cover, a pair of pivot pins movable disposed in the pair of pivot chambers, and a pair of elastic members disposed between inner walls of the pair of pivot chambers and the pair of pivot pins, respectively. Each of the pair of pivot pins is capable of retractably extending out of the pivot chamber to insert into the pair of pivot grooves of the lid body under action of the elastic member.

In some embodiments, the lid body includes an opening portion configured to define the liquid outlet, a second pin joint portion extending from the opening portion, and a peripheral portion surrounding the opening portion, and an inner wall of the second pin joint portion of the lid body is capable of curving outwards to define the pivot groove and the detaching groove.

In some embodiments, the opened state of the container lid further includes a fixed opened state. The outlet lid further includes a clamping portion extending out from the sealing cover. The clamping portion of the outlet lid is configured to clamp the peripheral portion of the lid body, so that the container lid is capable of being maintained in the closed state or the fixed opened state.

In some embodiments, the peripheral portion of the lid body is provided with a matching groove at a position near the liquid outlet, and the peripheral portion is provided with a matching protrusion at a position away from the liquid outlet. The clamping portion of the outlet lid includes a clamping protrusion matched with the matching groove and a clamping groove matched with the matching protrusion. When the container lid is in the closed state, the clamping protrusion of the clamping portion is latched with the matching groove of the peripheral portion. When the container lid is in the fixed open state, the clamping groove of the clamping portion is latched with the matching protrusion of the peripheral portion.

In some embodiments, the clamping portion of the outlet lid includes a first longitudinal sidewall extending along a longitudinal direction of the sealing cover, a middle horizontal wall extending along a horizontal direction from the first longitudinal sidewall and a second longitudinal sidewall extending along the longitudinal direction from the middle horizontal wall. An accommodating groove configured to accommodate the peripheral portion is defined between an outer surface of the first longitudinal sidewall and an inner surface of the second longitudinal sidewall. The clamping protrusion of the clamping portion and the clamping groove of the clamping portion are disposed at the inner surface of the second longitudinal sidewall and the inner surface of the first longitudinal sidewall, respectively. Both the matching groove of the lid body and the matching protrusion of the lid body are disposed on an outer surface of the peripheral portion.

The container lid of the present disclosure can overcome defects such as difficult to clean and hard to remove deposited dirt of conventional container lids. An outlet lid of the present container can switch the container lid between an opened state and a closed state. In addition, the outlet lid can be detached from the lid body, so as to facilitate adequate cleaning of the outlet lid and the lid body at any time, especially cleaning deposited dirt in fine positions of the outlet lid or the lid body. Therefore, the container can be used more conveniently, and more sanitary.

Figure 1:
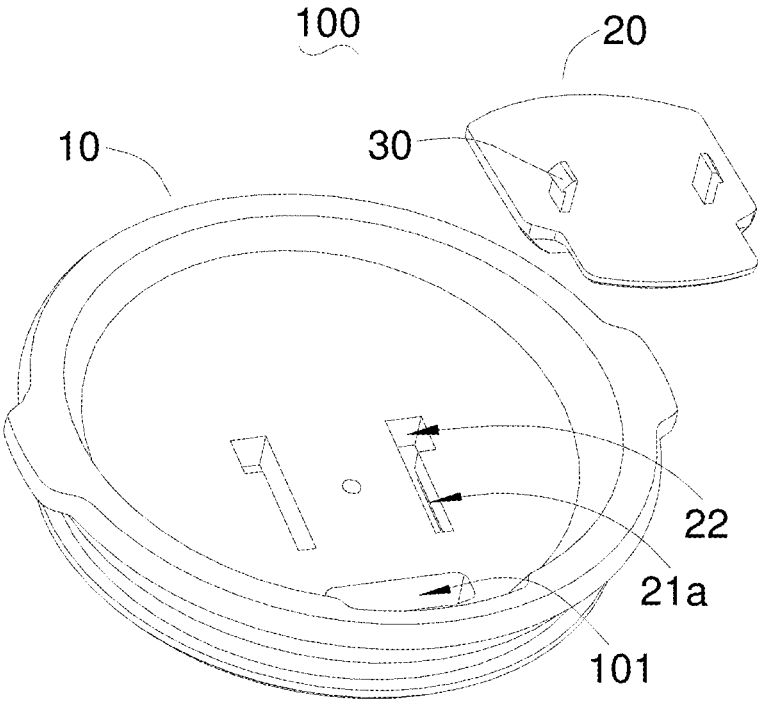
FIG. 1 is an explosive view of a container lid in a first embodiment of the present disclosure.
Figure 2:
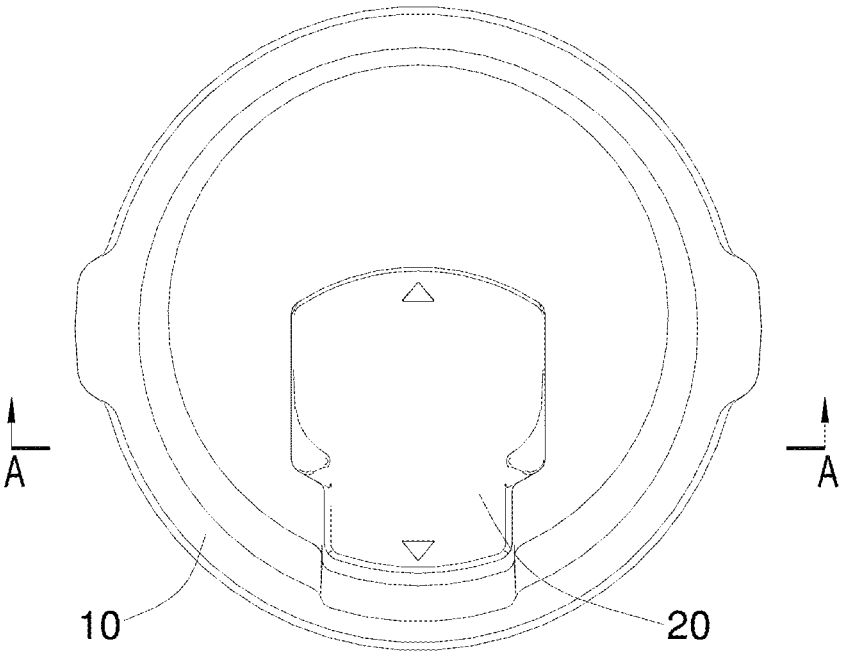
FIG. 2 is a structural schematic diagram of the container lid of FIG. 1 in a closed state.
Figure 3:
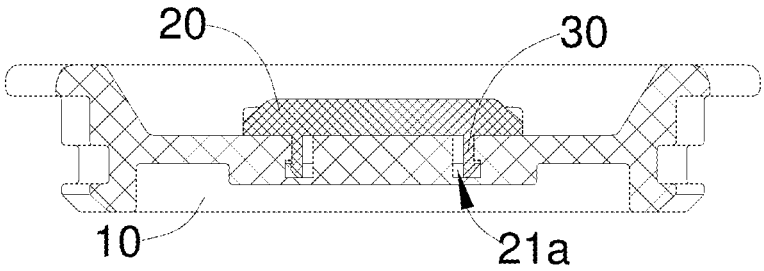
FIG. 3 is a sectional view of the container lid in FIG. 2 along A-A line.
Figure 4:
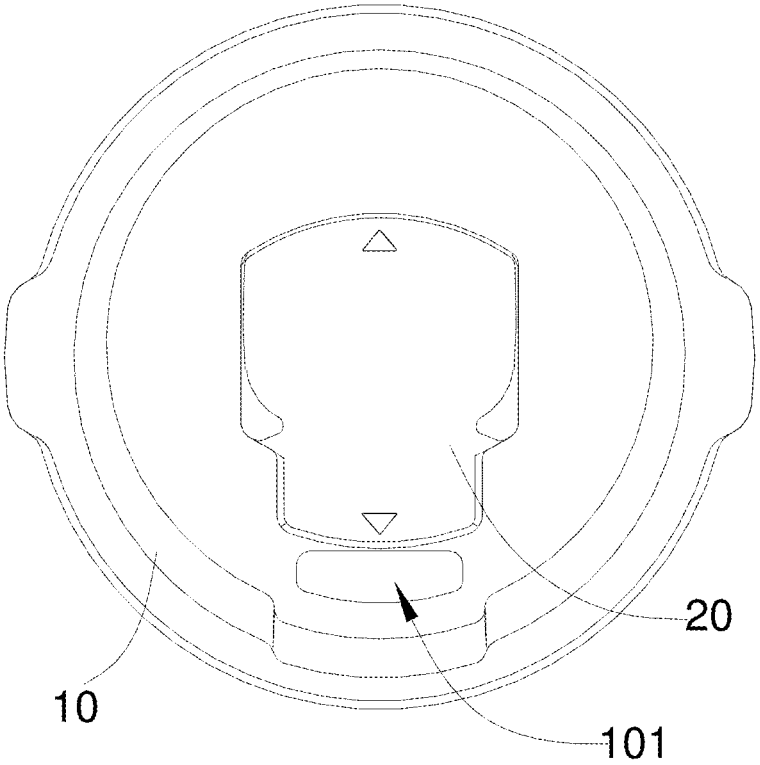
FIG. 4 is a structural schematic diagram of the container lid of FIG. 1 in an opened state.
Figure 5:
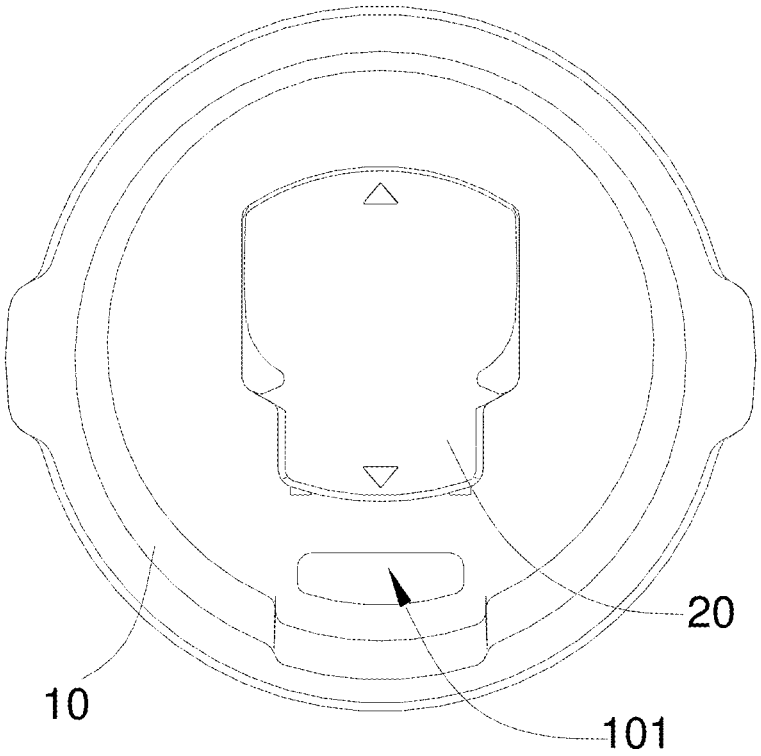
FIG. 5 is a structural schematic diagram of the container lid of FIG. 1 in a detachable state.
Figure 6:
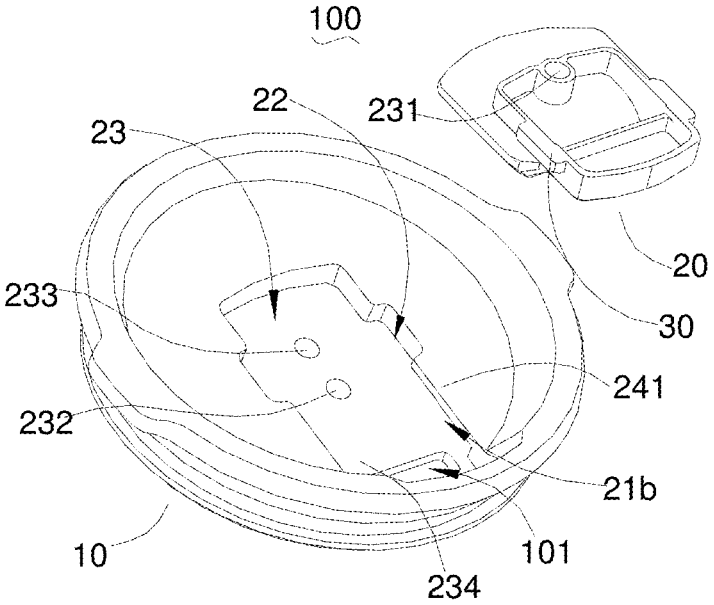
FIG. 6 is an explosive view of a container lid in a second embodiment of the present disclosure.
Figure 7:
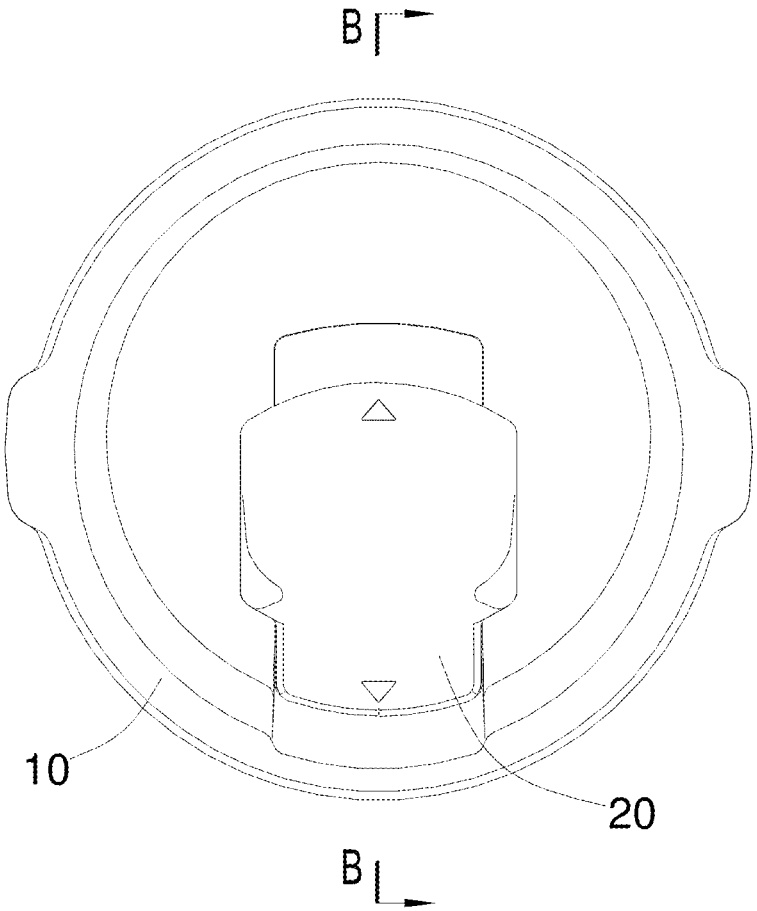
FIG. 7 is a structural schematic diagram of the container lid of FIG. 6 in a closed state.
Figure 8:
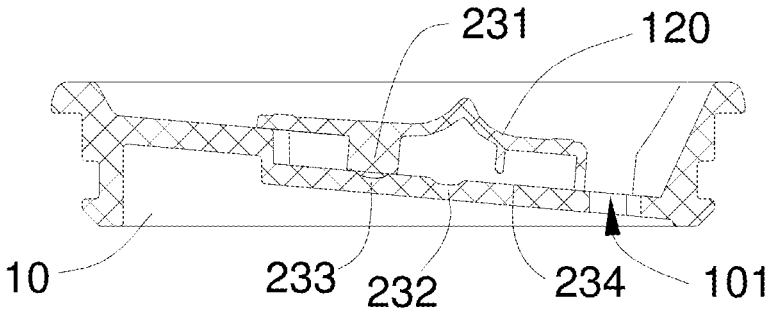
FIG. 8 is a sectional view of the container lid in FIG. 7 along B-B line.
Figure 9:
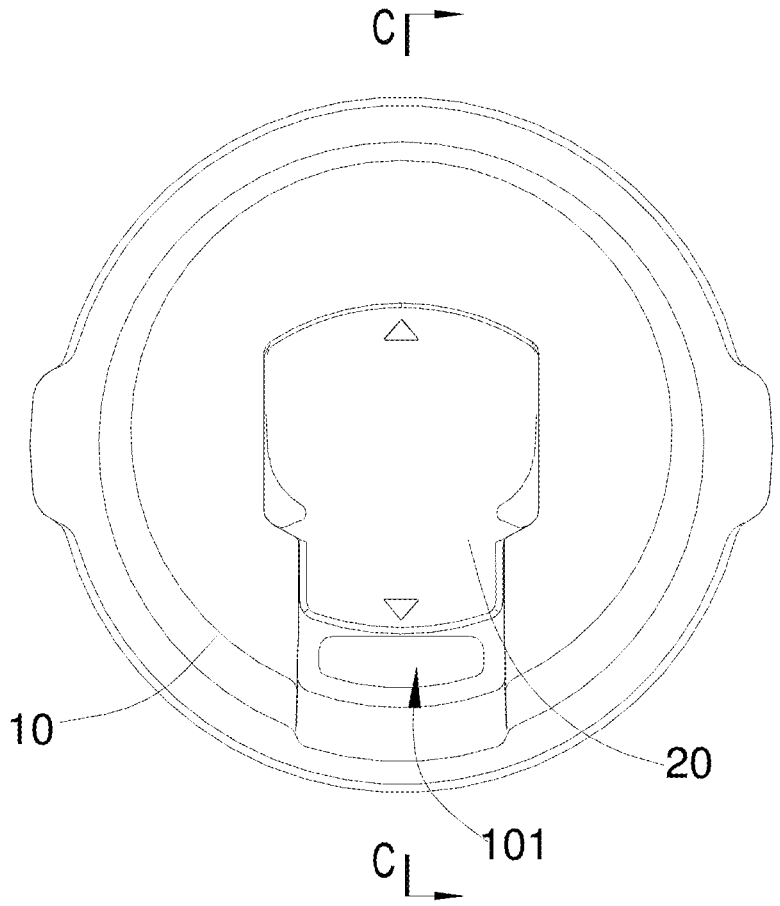
FIG. 9 is a structural schematic diagram of the container lid of FIG. 6 in an opened state.
Figure 10:
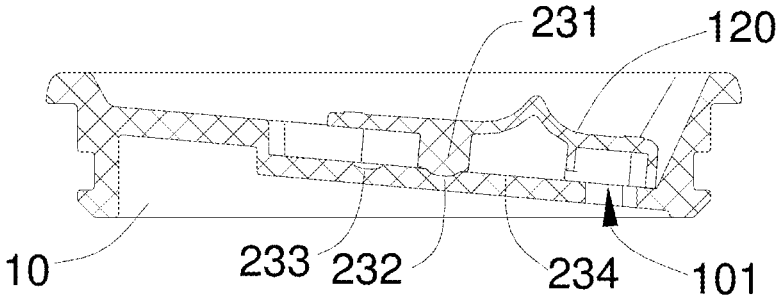
FIG. 10 is a sectional view of the container lid in FIG. 9 along C-C line.
Figure 11:
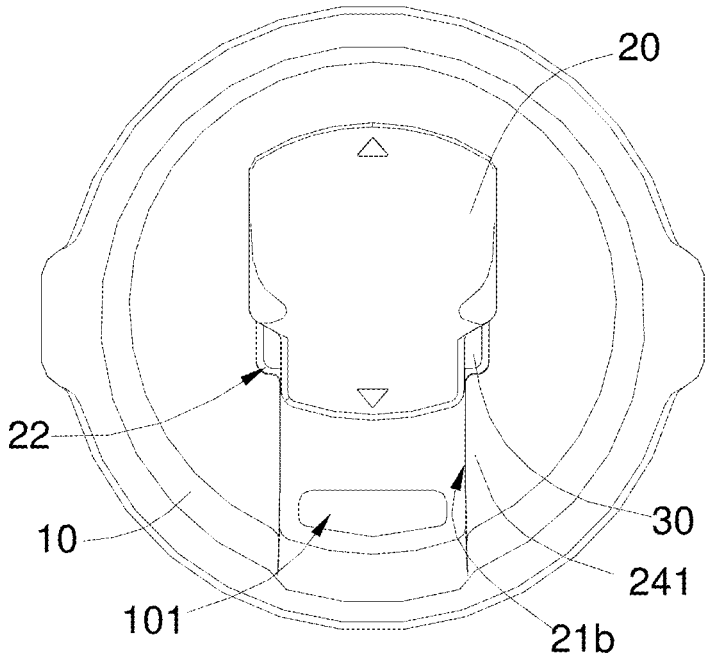
FIG. 11 is a structural schematic diagram of the container lid of FIG. 6 in a detachable state.
Figure 12:
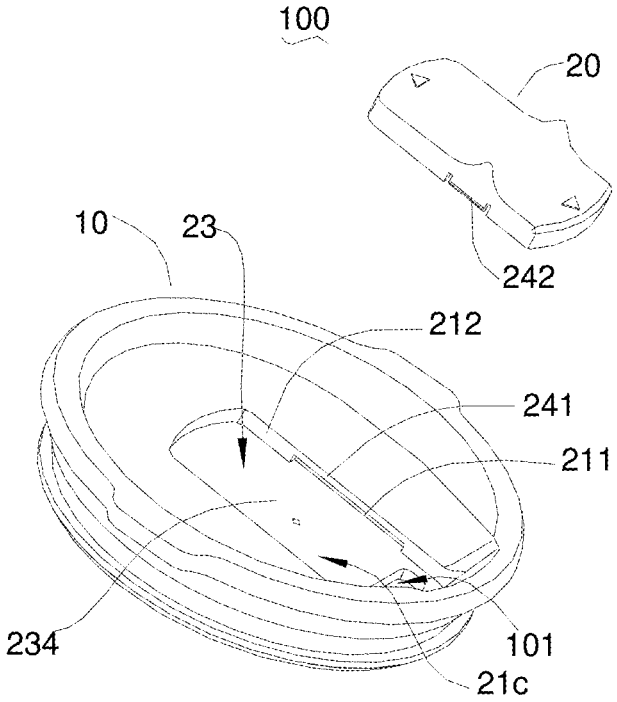
FIG. 12 is an explosive view of a container lid in a third embodiment of the present disclosure.
Figure 13:
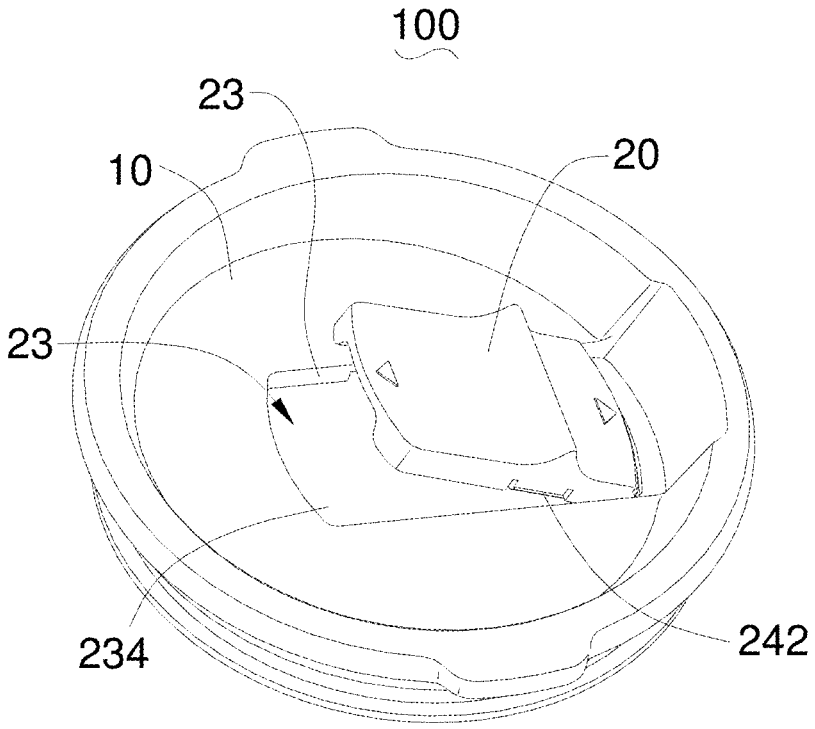
FIG. 13 is a stereoscopic structural diagram of the container lid in third embodiment of the present disclosure.
Figure 14:
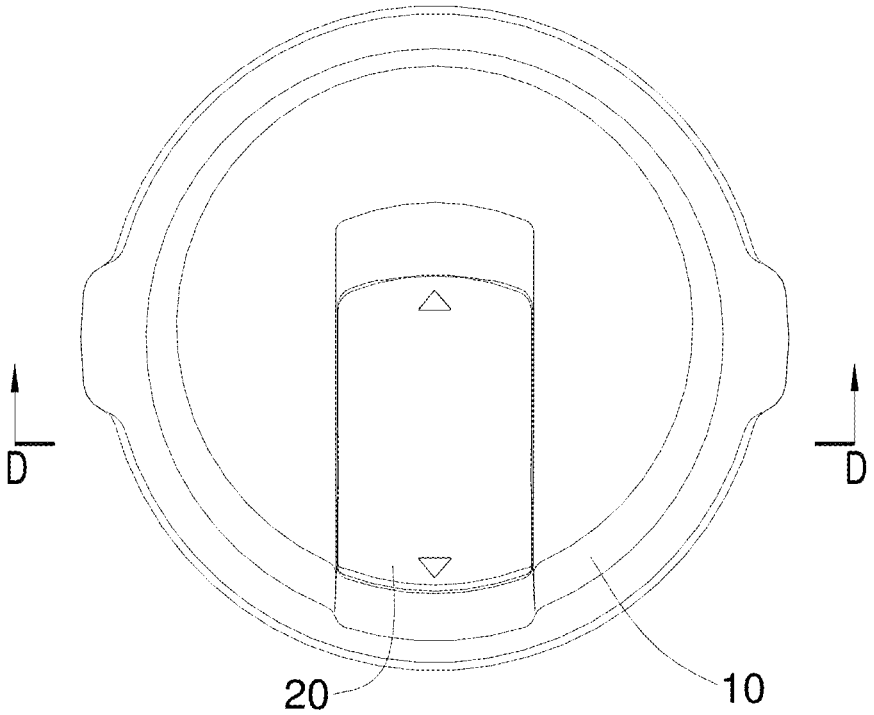
FIG. 14 is a structural schematic diagram of the container lid of FIG. 13 in an opened state.
Figure 15:
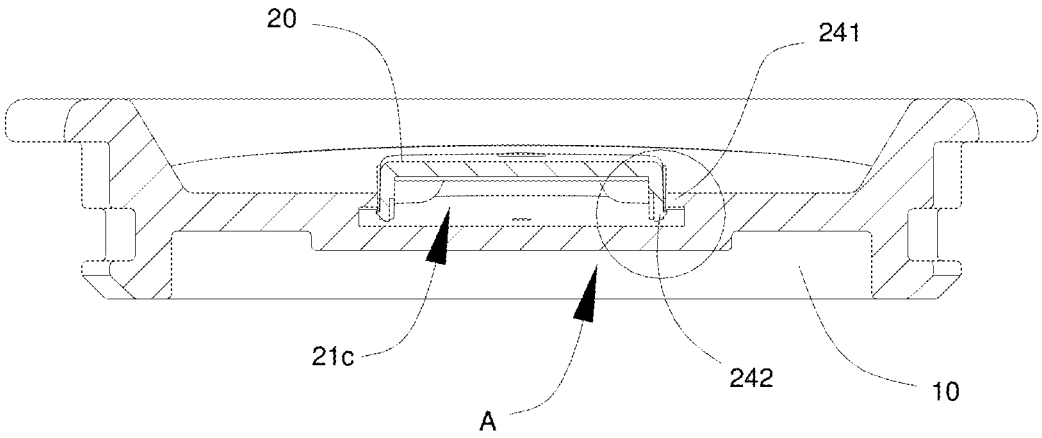
FIG. 15 is a sectional view of the container lid in FIG. 14 along D-D line.
Figure 16:
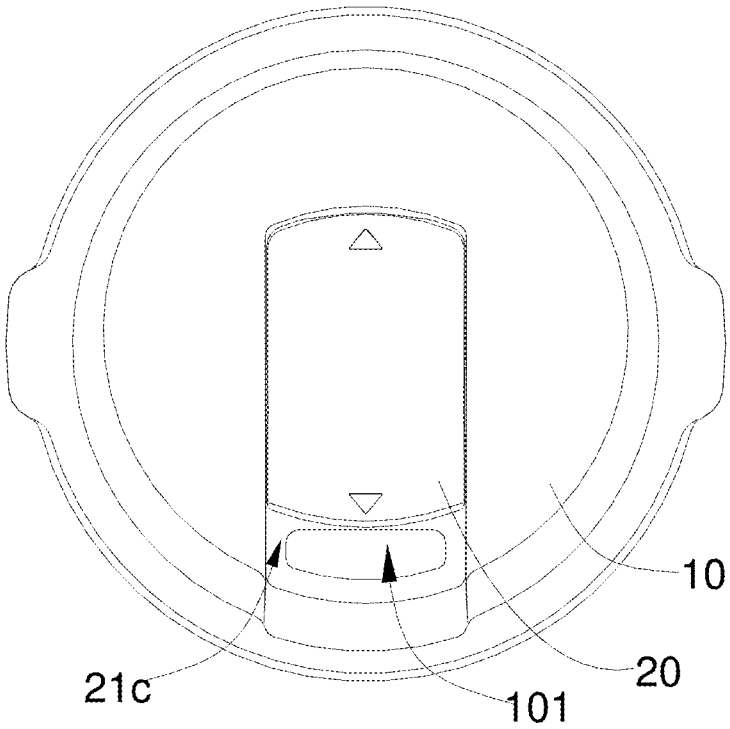
FIG. 16 is a structural schematic diagram of the container lid of FIG. 13 in a closed state.
Figure 17:
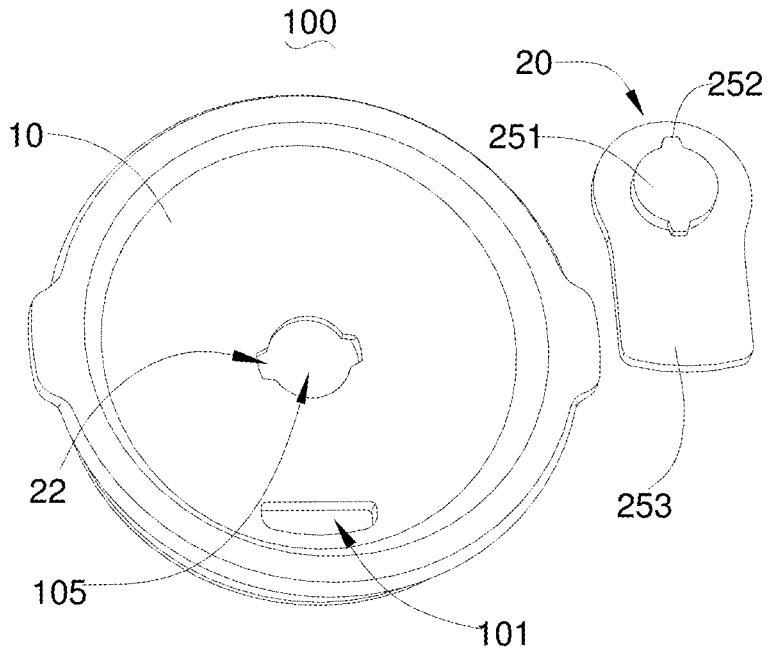
FIG. 17 is an explosive view of a container lid in a fourth embodiment of the present disclosure.
Figure 18:
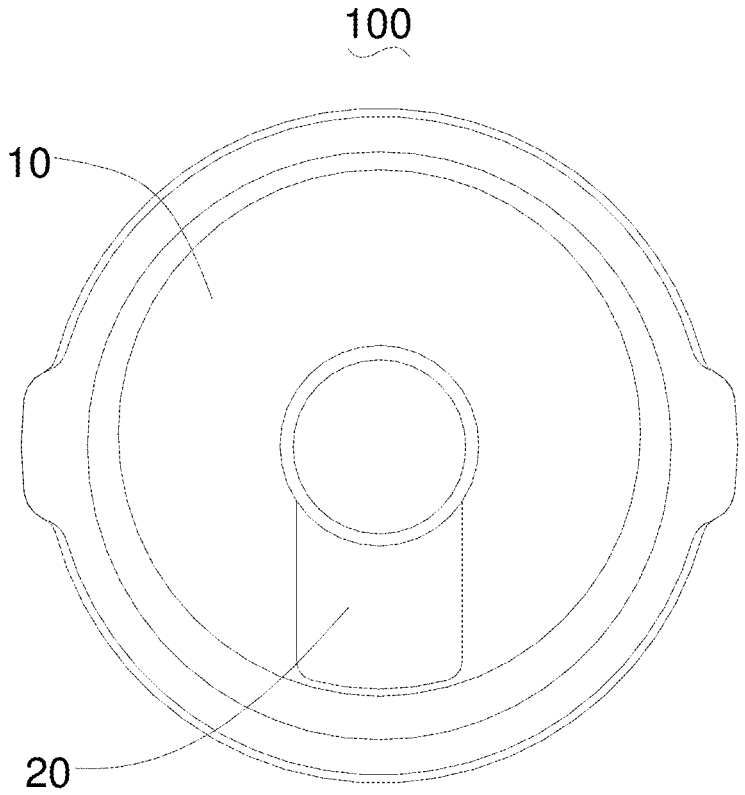
FIG. 18 is a structural schematic diagram of the container lid of FIG. 17 in a closed state.
Figure 19:
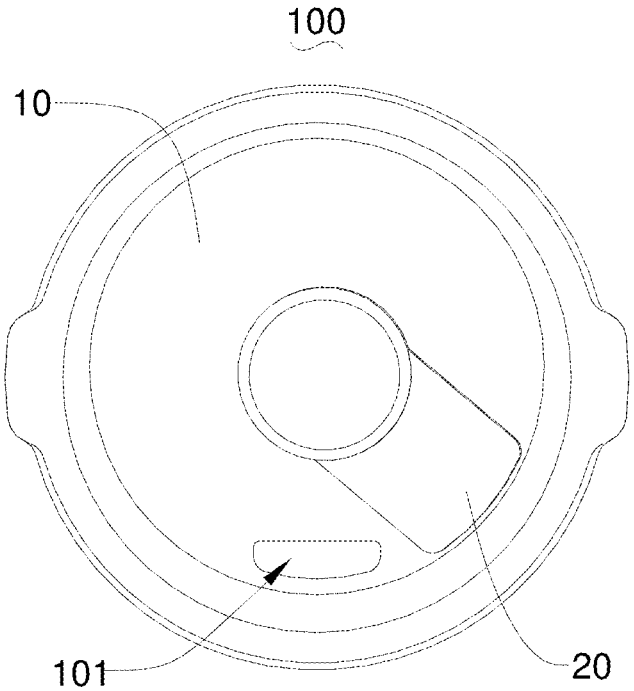
FIG. 19 is a structural schematic diagram of the container lid of FIG. 17 in an opened state.
Figure 20:
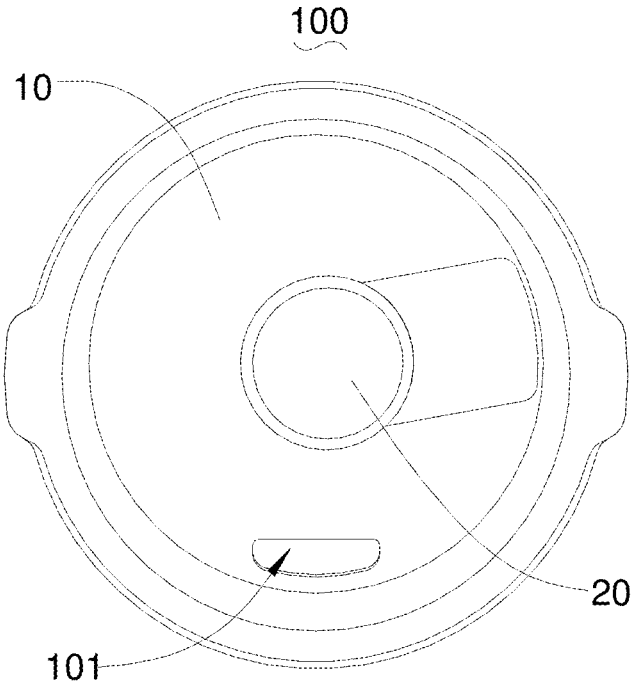
FIG. 20 is a structural schematic diagram of the container lid in FIG. 17 at a detachable position.

In the figures, 100 represents a container lid; 10 represents a lid body; 101 represents a liquid outlet; 102 represents a pivot groove; 103 represents a detaching groove; 104 represents an air hole; 105 represents a pivot hole; 11 represents an opening portion; 12 represents a second pin joint portion; 13 represents a peripheral portion; 131 represents a matching groove; 132 represents a matching protrusion; 20 represents an outlet lid; 21*a*/21*b*/21*c* represent a sliding channel; 211 represents a first section; 212 represents a second section; 22 represents an opening; 23 represents a groove; 231 represents a first latching portion; 232 represents a second latching portion; 233 represents a third latching portion; 234 represents a bottom surface; 241 represents a limiting plate; 242 represents an elastic protrusion; 2421 represents an inclined surface; 251 represents a first joint portion; 252 represents a limiting protrusion; 253 represents a shielding portion; 26 represents a pivot portion; 260 represents a deforming groove; 261 represents a pivot chamber; 262 represents a pivot pin; 263 represents an elastic member; 271 represents a sealing cover; 272 represents a flexible member; 28 represents a sealing member; 29 represents a clamping portion; 2901 represents a clamping protrusion; 2902 represents a clamping groove; 2903 represents an accommodating groove; 291 represents a first longitudinal sidewall; 292 represents a middle horizontal wall; 293 represents a second longitudinal sidewall; 30 represents a sliding block.

DETAILED DESCRIPTION

The technical solutions in the embodiments of the present disclosure will be clearly and completely described below with reference to the accompanying drawings in the embodiments of the present disclosure. Obviously, the described embodiments are only a part of the embodiments of the present disclosure, but not all of the embodiments. Based on the embodiments in the present disclosure, all other embodiments obtained by a skilled person in the art without creative work fall within the protective scope of the present disclosure.

Unless otherwise defined, all technical and scientific terms used herein have the same meaning as a skilled person in the art would understand. The terminology used in the description of the present disclosure is for the purpose of describing particular embodiments and is not intended to limit the disclosure. As used herein, the term "or/and" includes any and all combinations of one or more of the associated listed items.

Currently, a class of portable containers consisted of a container body and a lid thereof are popular in the market. In addition to the lid body provided with the liquid outlet, the container lid of the container further includes an outlet lid movably mounted on the lid body. The outlet lid can open or seal the liquid outlet by moving along a predetermined track on the lid body.

The portable containers can not only be used to store water, but in some occasions, users also use the containers to hold liquids such as tea, coffee, and the like. After the container is used for a long time, dirt may deposit on the liquid outlet, the lid body and the outlet lid. Due to the limitation of installation structure of the outlet lid and the lid body, the container lid may be difficult to clean, and it is difficult or even impossible to clean the container lid thoroughly.

In view of above, the present disclosure can provide a container lid 100, which can match with a container body to consist a container. The container lid 100 can include a lid body 10 and an outlet lid 20 movably connected to the lid body 10. The lid body 10 can be provided with a liquid outlet 101 communicated with an inner chamber of the container body. The container lid 100 can have a closed state, an opened state, and a detachable state. When the container lid 100 can be in the closed state, the liquid outlet 101 can be closed with the outlet lid 20. When the container lid 100 can be in the opened state, the liquid outlet 101 can be opened with the outlet lid 20. When the container lid 100 can be in the detachable state, the outlet lid 20 can be separated from the lid body 10. After the outlet lid 20 is detached from the lid body 10, a user can sufficiently wash the outlet lid 20 and the lid body 10, respectively.

It should be noted that the outlet lid 20 and the lid body 10 can be assembled on the lid body 10 again after the outlet lid 20 is disassembled from the lid body 10. That is, the outlet lid 20 can be repeatedly disassembled from the lid body 10 or assembled on the lid body 10 without affecting use of the container lid 100.

The container lid 100 in the present disclosure can match with different kinds of container bodies to consist containers. The container can be portable water cups, kettles, or bottles, boxes or cylinders used to hold edible oil, liquid adhesives, chemical raw materials or disinfectants. Thus, application situations of the container lid 100 and the container is not limited in the present disclosure. The structure and the function of the container lid 100 will be described in details hereinafter, taking the portable cup formed by the combination of the container lid 100 and the container body as an example.

In some embodiments, the lid body 10 can be provided with a first preset path and a second preset path, and the outlet lid 20 can be capable of switching between the first preset path and the second preset path. When the outlet lid 20 moves along the first preset path, the liquid outlet 101 can be completely or partially sealed by the outlet lid 20, or the outlet lid 20 can be separated from the liquid outlet 101, so that the container lid 100 can be switched between the closed state and the opened state. When the outlet lid 20 moves along the second preset path, the container lid 100 can be switched between the opened state and the detachable state. That is, by operating the outlet lid 20 to move, the user can successively close and open the liquid outlet 101 of the container lid 100 and disassemble the outlet lid 20; or, can successively assemble the outlet lid 20 and open and close the liquid outlet 101 of the container lid 100.

It should be noted that in some embodiments, the outlet lid 20 can further move along the second preset path to switch the container lid 100 between the closed state and the detachable state. That is, by operating the outlet lid 20 to move, the user can successively open and close the liquid outlet 101 of the container lid 100 and disassemble the outlet lid 20; or, can successively assemble the outlet lid 20 and close and open the liquid outlet 101 of the container lid 100.

Therefore, a movement process of detaching the outlet lid 20 from the lid body 10 can be separated from a movement process of opening or closing the liquid outlet 101 on the lid body 10 via the outlet lid 20, so that the outlet lid 20 will not separate from the lid body 10 while the container lid 100 switching between the opened state and the closed state, and the container lid 100 can be normally used.

The container lid 100 in a first embodiment of the present disclosure will be described in details hereinafter.

Referring to FIG. 1 to FIG. 5, in the first embodiment, the first preset path can include a sliding channel 21*a*, the second reset path can include an opening 22. The sliding channel 21*a* is in communication with the opening 22, and configured to lead the outlet lid 20 to move along a surface of the lid body 10. The container lid 100 can further include a sliding block 30 fixed to the outlet lid 20 and matched with the sliding channel 21*a*.

The sliding block 30 can move toward the opening 22 until being inserted into the opening 22, and can further move along the first preset path, thus the outlet lid 20 can be slidably connected to the lid body 10. Upon conditions that the outlet lid 20 is slidably connected to the lid body 10, the sliding block 30 can move along the first preset path to the opening 22, and then along the second preset path to separate from the opening 22. That is, the opening 22 is capable of allowing the outlet lid 20 to be detached from the lid body 10.

Therefore, when the outlet lid 20 moves along the sliding channel 21*a*, the container lid 100 can be switched between the opened state and the closed state. When the outlet lid 20 reaches the opening 22, the outlet lid 20 can be disassembled and separated from the lid body 10. That is, a movable connecting area and a detachable separating area of the outlet lid on the lid body 10 are independent and determinate.

In the first embodiment, the sliding block 30 can be fixed on a side of the outlet lid 20 near the lid body 10. The sliding block 30 can include a first end near the outlet lid 20 and a second end away from the outlet lid 20. When the outlet lid 20 is slidably connected to the lid body 10, a direction from the first end of the sliding block 30 towards the second end of the sliding block 30, that is, a height direction of the sliding block is in accordance with a depth direction of the sliding channel 21; a direction of the first preset path, that is, a direction along which the outlet lid 20 moves to open and close the liquid outlet 101, is in accordance with a length direction of the sliding channel 21*a*; and, a width direction of the sliding channel 21*a* is perpendicular to both a depth direction of the sliding channel 21*a* and a length direction of the sliding channel 21*a*.

A size of the first end along the width direction of the sliding channel 21*a* can be smaller than a size of the second end along the width direction of the sliding channel 21*a*. The sliding channel 21*a* includes a first inner wall and a second inner wall opposite to the first inner wall along the width direction thereof. A projection of the sliding block 30 on a plane perpendicular to the length direction of the sliding channel 21*a* can be substantially the same with that of the first inner wall and second inner wall on the plane perpendicular to the length direction of the sliding channel 21*a*, and the first inner wall and/or the second inner wall are configured to limit the sliding block 30 to prevent the sliding channel from departing from the sliding channel 21*a*.

In some embodiments, the projection of the sliding block 30 on a plane perpendicular to the length direction of the sliding channel 21*a*, the projection of the first inner wall and the second inner wall on the plane perpendicular to the length direction of the sliding channel 21*a* can be trapezoid-shaped, including right trapezoid-shaped, non-right trapezoid-shaped, or, can have other shapes.

Therefore, the first inner wall and/or the second inner wall can have a better limiting effect when limiting the sliding block 30 and the outlet lid 20. The outlet lid 20 can be movably and reliably connected to the lid body 10. The container lid 100 can have a simple structure and be easy to process.

In some embodiments, the projection of the sliding block 30 on the plane perpendicular to the length direction of the sliding channel 21*a*, and the projection of the first inner wall and second inner wall on the plane perpendicular to the length direction of the sliding channel 21*a* are L-shaped. That is, a first step-shaped surface can be disposed between the first inner wall and the sliding block 30, and/or, a second step-shaped surface can be disposed between the second inner wall and the sliding block.

Therefore, a sliding matching between the sliding block 30 and the sliding channel 21*a* can be reliable and smooth.

The user can operate the outlet lid 20 to open or close the container lid 20 with littler labor without concern that the outlet lid 20 may be detached from the lid body 10.

In some embodiments, the sliding block 30 and the outlet lid 20 can be integrally formed. It could be understood that in some embodiments, the sliding block 30 and the outlet lid 20 can be independently processed and fixed together.

In some embodiments, the sliding channel 21*a* can be a blind slot that does not extend through the lid body 10, that is, the sliding channel 21*a* is provided with a bottom surface disposed towards the outlet lid 20. Therefore, the bottom surface can prevent liquid in the container from flowing out from the sliding channel 21*a*, and preventing external impurities from entering into the container and causing pollution from the sliding channel 21*a*.

It could be understood that in some embodiments, the sliding channel 21*a* can be a blind slot extending through the lid body 10. In some embodiments, a first plate and a second plate can be disposed along an axis of the lid body 10, respectively; and, the sliding channel 21*a* can be disposed on the first plate and extend through the first plate, and the second plate can be an enclosed structure configured to isolate the external environment and the inside of the container.

Furthermore, in some embodiments, the number of the sliding cannel 21*a* and the number of the opening 22 can be two, respectively. The number of the sliding block 30 can be two, and the two sliding blocks 30 can be opposite disposed along the width direction of the sliding channel 21*a*.

It cloud be understood that in some embodiments, the number of the sliding channel 21*a*, the number of the opening 22 and the number of the sliding block 30 can be three or over three, or, can be only one.

A container lid 100 in a second embodiment of the present disclosure is described in details hereinafter.

Referring to FIG. 6 to FIG. 11, in the second embodiment, the first preset path can include a sliding channel 21*b*, the second reset path can include an opening 22. The sliding channel 21*b* is in communication with the opening 22, and configured to lead the outlet lid 20 to move along a surface of the lid body 10. The container lid 100 can further include a sliding block 30 fixed to the outlet lid 20 and matched with the sliding channel 21*b*.

In some embodiments, a side of the lid body near the outlet lid is provided with a concave groove 23. The groove 23 can be disposed at the side of the lid body along a width direction of the sliding channel 21*b*, and can be in communication with the sliding channel 21*b*, the opening 22 and the liquid outlet 101. The lid body can be further provided with a limiting plate 241 extending along the first preset path. The limiting plate 241 protrudes inwards the groove 23. A sliding gap can be defined between the limiting plate 241 and a bottom surface 234 of the sliding channel 21*b* away from the outlet lid 20.

In the embodiment, optionally, the number of the sliding channel 21*b* and the number of the opening 22 can be two. The two sliding channels 21*b* can be disposed in parallel, and the groove 23 can be disposed between the two sliding channels 21*b*. The two sliding channels 21*b* can be provided with a first sidewall and a second sidewall disposed opposite to the first sidewall. The number of the limiting plate 241 can be two. The outlet lid 20 can be movably accommodated in the groove 23. The number of the sliding blocks 30 can be two. Shapes of the two sliding blocks 30 can match with a shape of the opening of the opening 20. The two sliding blocks 30 can be fixed at two sides of the outlet lid 20 opposite to each other, and protrude towards the first sidewall and the second sidewall and extend into the two sliding gaps, respectively.

When the sliding block 30 moves in the sliding channel 21*b*, the limiting plate 241 can be capable of limiting the sliding block 30 to prevent the outlet lid 20 from being detached from the groove 23. When the sliding block 30 moves to the opening 22, the sliding block 30 can be separated with the lid body 10 from the opening 22 along an axis of the lid body 10, so as to disassemble the outlet lid from the lid body 10.

It could be understood that in some embodiments, the number of the sliding channel 21*b*, the number of the opening 22, the number of the limiting plate 241 and the number of the sliding block 30 can be one.

Therefore, the limiting plate 241 can reliably limit the sliding block 30 and the outlet lid 20. Thus, in a process of switching the container lid 100 between the closed state and the opened state, the limiting plate 241 can prevent the sliding block 30 from separating from the sliding gap, so as to prevent the outlet lid 20 from accidently departing from the lid body 10.

Furthermore, in the second embodiment, a side of the outlet lid 20 towards the groove 23 can be provided with a first latching portion 231, and a bottom surface of the groove 23 can be provided with a second latching portion 232 and a third latching portion 233, respectively. The first latching portion 231 can be capable of matching with the second latching portion 232 to keep the container lid 100 in the closed state. At this time, the user can further apply force on the outlet lid 20 to drive the first latching portion 231 to release from the matching between the first latching portion 231 and the second latching portion 232, so as to open the liquid outlet 101. The first latching portion 231 can be capable of matching with the third latching portion 233 to keep the container lid 100 in the opened state. At this time, the user can further apply force on the outlet lid 20 to drive the first latching portion 231 to release from the matching between the first latching portion 231 and the third latching portion 233, so as to detach the outlet lid 20 from the lid body 10.

Therefore, when the user drinks, the outlet lid 20 will not spontaneously move to close the liquid outlet 101 and cut off the liquid. In addition, when the container lid 100 is in the closed state, the outlet lid 20 will not spontaneously move to open the liquid outlet 101, so as to prevent water from leaking. Thus, using experience can be improved.

In some embodiments, the first latching portion 231 can be disposed at an end of the sliding block 30 relatively near the first sidewall and/or the second sidewall. At this time, the second latching portion 232 and the third latching portion 233 can be correspondingly disposed on the first sidewall and/or the second sidewall of the two sliding channels 21*b*, respectively.

Furthermore, in some embodiments, the first latching portion 231, the second latching portion 232 and the third latching portion 233 can be made of elastic materials, respectively. In some embodiments, the first latching portion 231, the second latching portion 232 and the third latching portion 233 can be provided with a retractable hole, so that the first latching portion 231, the second latching portion 232 and the third latching portion 233 can be elastic.

Therefore, through the retractable hole, a risk of cracking and failing of the first latching portion 231, the second latching portion 232 and the third latching portion 233 can be avoided when the user applies force on the outlet lid 20 quickly.

In some embodiments, the lid body 10 can be provided with a third preset path, and the third preset path can include an opened position, a closed position and a detachable position corresponding to the opened state, the closed state and the detachable state, respectively. The outlet lid 20 can be capable of moving along the third preset path, so as to make the container lid 100 switch between the closed state and the opened state, between the closed state and the detachable state or, switch between the opened state and the detachable state.

When the outlet lid 20 moves to the opened position, the outlet lid 20 can be capable of giving way to the liquid outlet 101. When the outlet lid 20 moves to the closed position, the liquid outlet 101 can be covered/sealed by the outlet lid 20. When the outlet lid 20 moves to the detachable position, the user can directly detach the outlet lid 20 from the lid body 10. After the outlet lid 20 and the lid body 10 are washed, the user can assemble the outlet lid 20 on the lid body again at the detachable position.

A third embodiment of the present disclosure is described in details hereinafter.

Referring to FIG. 12 to FIG. 16, in the third embodiment, a side of the lid body 10 near the outlet lid 20 curves inwards to form a groove 23. The groove 23 can communicate with the liquid outlet 101 and accommodate the outlet lid 20. In a direction along the third preset path, a size of the groove 23 is greater than that of the outlet lid 20. Therefore, a margin of movement of the outlet lid 20 can be preset in the groove 23 along the third preset path, facilitating opening and closing the liquid outlet 101 with the outlet lid 20. A width direction of the groove 23 can be perpendicular to both a direction of the third preset path and a depth direction of the groove 23. A size of the groove 23 along the width direction of the groove is greater than or equal to that of the outlet lid 20.

In some embodiments, the groove 23 can include two sidewalls opposite to each other along a width direction of the groove 23, and each of the sidewalls can include a first section 211 and a second section 212 along the third preset path, respectively. The first section can be relatively near the liquid outlet 101, and the second section 212 can be relatively away from the liquid outlet 101. The groove 23 can define a second preset path in an area corresponding to the second section 212, and a direction of the second preset path is along a depth direction of the second section 212 in the groove 23. An area corresponding to the first section 211 in the groove 23 can form a sliding channel 21*c*, which is configured to define the third preset path. Side portions of the outlet lid 20 near the sliding channel, that is, two sides towards the first section 211 of the outlet lid 20, can be provided with two elastic protrusions 242, respectively. The two elastic protrusions 242 can elastically deform along the width direction of the groove 23 under action of the external force, and a distance between the two elastic protrusions 242 decreases after the two elastic protrusions 242 deforms.

Along a direction the two elastic protrusions 242 elastically deform, a size of the first section 211 can be greater than that of the second section 212, and a size of the first section 211 can be greater than a maximum direction between the two elastic protrusions 242. A size of the second section 212 can be greater than a distance between the two side portions of the outlet lid 20 near the sliding channel 21*c*, and a size of the second section 212 can be smaller than a maximum distance between the two elastic protrusions 242. In the embodiment, the size of the first section 211 can be a distance between the two first sections 211 disposed opposite to each other; the size of the second section 212 can be a distance between the two second sections 212 disposed opposite to each other; and the maximum distance between the two elastic protrusion 242 can be a distance between the two elastic protrusions 242 when the two elastic protrusions 242 does not deform.

It could be understood that in some embodiments, the first section 211 and the second section 212 can be independently disposed on one sidewall along a width direction of the groove 23; and, the other sidewall can be a continuous plane, and an elastic protrusion 242 can be independently disposed on one side of the outlet lid 20 near the first section 211 at the same time. At this time, the size of the first section 211 is a distance from the first section 211 to the other sidewall; the size of the second section 211 is a distance from the second section 212 to the other sidewall.

At the side of the lid body 10 near the outlet lid 20 can be further provided with two limiting plates 241 extending along the third preset path. The two limiting plates 241 can be corresponding to the two first sections 211, respectively, and protrude inwards the groove 23. Two sliding gaps are formed between the two limiting plate 241 and a bottom surface of the groove 23. The two elastic protrusions 242 can be slidably disposed in the two sliding gaps. The two limiting plates 241 can limit the two elastic protrusions 242 to prevent the outlet lid 20 from departing from the lid body 10.

The outlet lid 20 can drive the elastic protrusion 242 to slide in the sliding channel 21*c*, while the elastic protrusion 242 is not extruded by the first section 211. When the user applies a greater force on the outlet lid 20, the outlet lid 20 can drive the elastic protrusion 242 to move from the first section 211 to the second section 212. Under the extrusion of the second section 212, the two elastic protrusions 242 can elastically deform and move towards each other. When the distance between the two elastic protrusions 211 decreases to not greater than the distance between the two second sections 212, the outlet lid 20 can be ejected out along the depth direction of the groove 23 under elastic effect of the elastic protrusion 242, so as to detach the outlet lid 20 from the lid body 10 via the second section 212.

After the user washes the outlet lid 20 and the lid body 10, the user can align the two elastic protrusions 242 with the second section 212 and press the two elastic protrusions 242 down forcefully. The edge and sidewall of the second section 212 can extrude the two elastic protrusions 242 to reduce the distance between the two elastic protrusions, until the outlet lid 20 is accommodated in the groove 23. Then the user can change a direction of the force applied on the outlet lid 20, making the outlet lid 20 moving into the sliding channel 21*c* again.

In the third embodiment, the third preset path can include a sliding channel 21*c* disposed corresponding to the first section 211 in the groove 23. An opened position is a position of the outlet lid 20 relative to the lid body 10 when the outlet lid 20 gives way to the liquid outlet 101. A closed position is a position of the outlet lid 20 relative to the lid body 10 when the outlet lid 20 is sealed on the liquid outlet 101. A detachable position is a position of the outlet lid 20 relative to the lid body 10 when the outlet lid 20 moves to a position the elastic protrusion 242 opposite to the second section 212.

Therefore, when the elastic protrusion 242 deforms under the action of the second section 212, the outlet lid 20 can automatically separate from the sliding channel 21*c*, so that the outlet lid 20 can be more easily to be detached from the lid body 10 and can be conveniently used and quickly detached.

Figure 43:
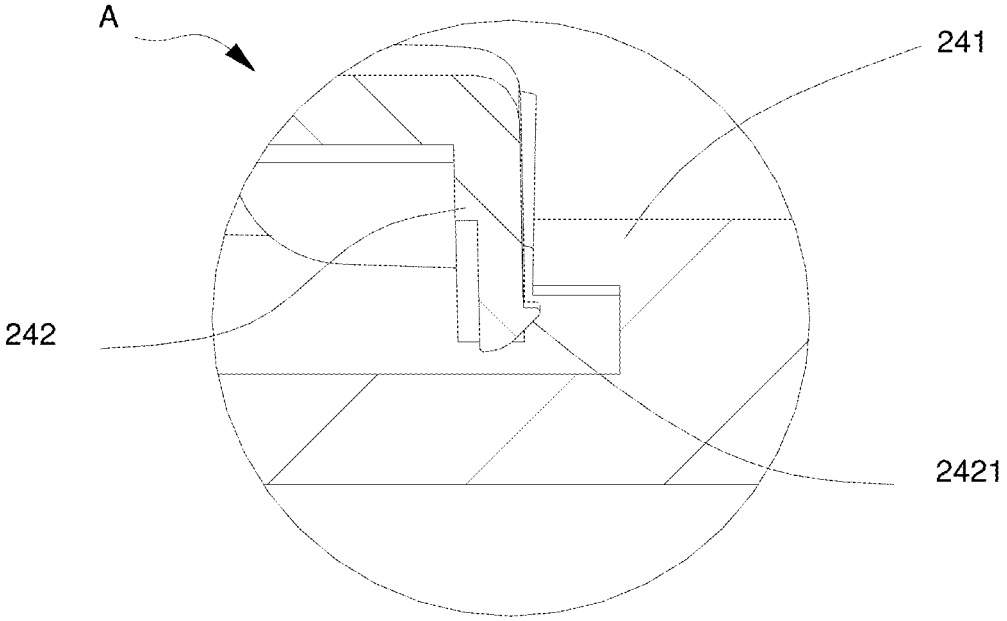
FIG. 43 is a partial enlarged figure of A portion in FIG. 15.

Furthermore, referring to FIG. 43, in the third embodiment, an end of the elastic protrusion 242 near the lid body 10 can be provided with an inclined surface 2421. The inclined surface 2421 is opposite to a bottom surface of the sliding channel 21*c* and a sidewall of the groove 23, and contacts with a sidewall edge of the second section 212.

Therefore, the sidewall edge of the second section 212 can effectively apply force on the elastic protrusion 242, and the outlet lid 20 and the lid body 10 can be more quickly assembled to a container lid 100 with less labor. In addition, since the inclined surface 2421 can avoid a sudden change of a force applied by the second section 212 on the elastic protrusion 242, a risk of breakage of the elastic protrusion 242 can be lowered.

In some embodiments, an angle between the inclined surface 2421 and the bottom surface 234 of the sliding channel 21*c* can be in a range of 30 degrees to 50 degrees.

A fourth embodiment of the present disclosure is described in details hereinafter.

Referring to FIG. 17 to FIG. 20, in the fourth embodiment, the outlet lid 20 can include a column-shaped first pin joint portion 251 and a sheet-shaped shielding portion 253. The shielding portion 253 can be fixed to an end of the first pin joint portion 251 and extend along a radial direction of a cross section of the first pin joint portion 251, and be configured to open and close the liquid outlet 101. The pin pivot portion 251 can be configured to rotatably connect the outlet lid 20 to the lid body 10. Another end of the first pin joint portion 251 away from the shielding portion 253 can be provided with a limiting protrusion 252 extending along the radial direction of the cross section of the first pin joint portion 251. That is, the first pin joint portion 251 can define a pivot section between the limiting protrusion 252 and the shielding portion 253.

The lid body 10 can be provided with a pivot hole 105 and an opening 22 communicated with the pivot hole 105. A size and a shape of the pivot hole 105 can match with a radial cross-section of the pivot section, and a size and a shape of the opening 22 can match with a size and a shape of the limiting protrusion 252. The pivot hole 105 can be configured for allowing the first pin joint portion 251 to extend in. The opening 22 can allow the limiting protrusion 252 to move along the axis of the lid body 10, so as to further allow the first pin joint portion 251 and the limiting protrusion 252 to move together in the pivot hole 105 and the opening 22. The limiting protrusion 252 can abut against a side of the lid body 10 near the inside of the container body, so as to prevent the outlet lid 20 from departing from the lid body 10 when the outlet lid 20 does not reach the detachable position.

In the fourth embodiment, the third preset path is a movement path of the outlet lid 20 rotating around the pivot hole 105 relative to the lid body 10 via the first pin joint portion 251. An opened position is a position of the outlet lid 20 relative to the lid body 10, in which the shielding portion 253 gives way to the liquid outlet 101. A closed position is a position of the outlet lid 20 relative to the lid body 10, in which the shielding portion is sealed on the liquid outlet 101. A detachable position is a position of the outlet lid 20 relative to the lid body 10, in which the outlet lid 20 is rotated to a position corresponding to the limiting protrusion 252 and the opening 22.

Therefore, the outlet lid 20 can be rotatably connected to the lid body 10 via the first pin joint portion 251, so that the container lid 100 can be more conveniently and easily opened and closed, and the assembly and disassembly between the outlet lid 20 and the lid body 10 can be more convenient.

Furthermore, in the fourth embodiment, a side of the shielding portion 253 away from the lid body 10 can be further provided with a controlling rib, which can be configured to allow the user to push the controlling rib, resulting in driving the outlet lid 20 to rotate on the lid body 10 by hand, thereby further improving comfort of the user.

Figure 31:
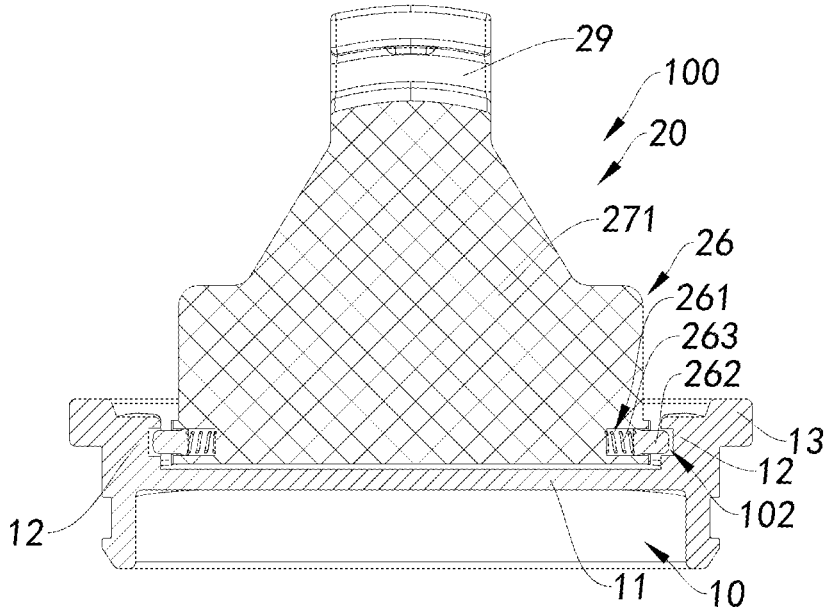
FIG. 31 is a longitudinal-sectional view of the container lid in FIG. 30 in a detachable opened state.
Figure 32:
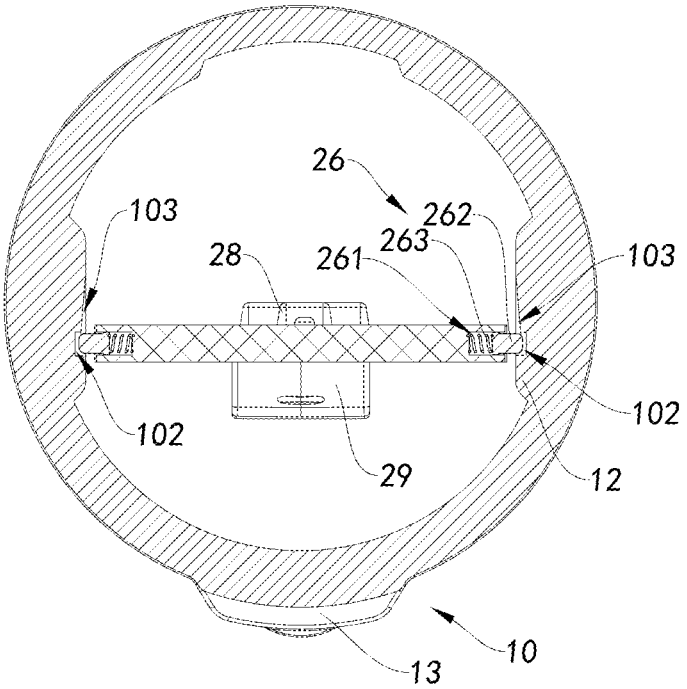
FIG. 32 is a cross-sectional view of the container lid in FIG. 30 in the detachable opened state.
Figure 33:
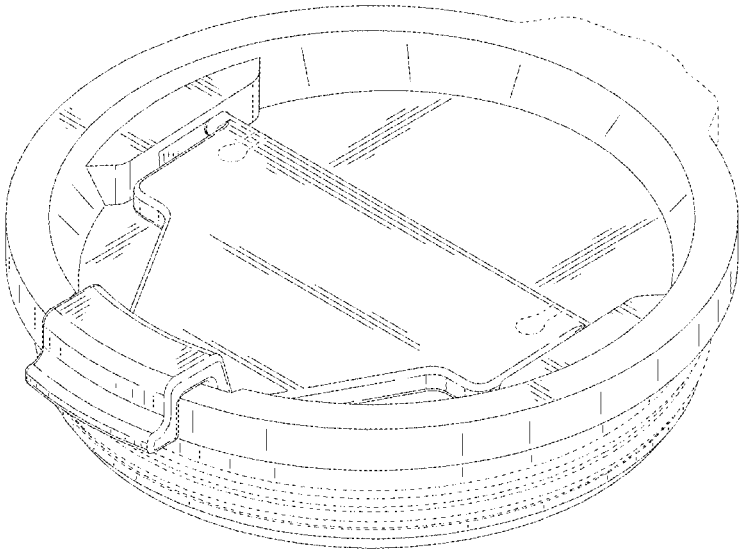
FIG. 33 is an embodiment of the container lid in an embodiment of the present disclosure.
Figure 34:
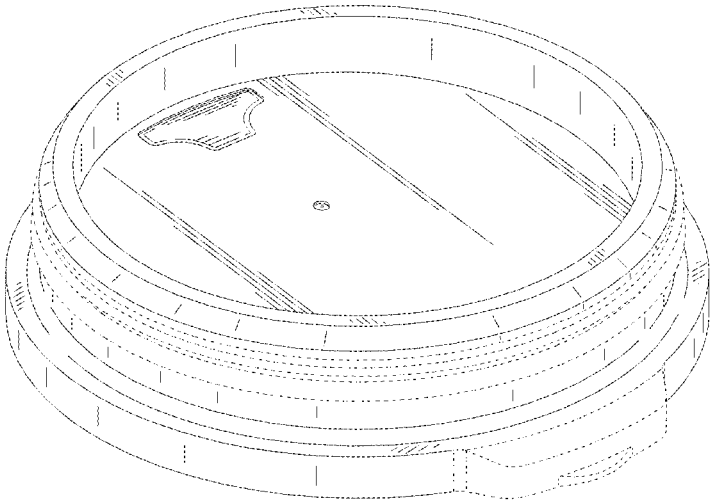
FIG. 34 is a structural schematic diagram of the container lid of FIG. 33 from another view angle.
Figure 35:
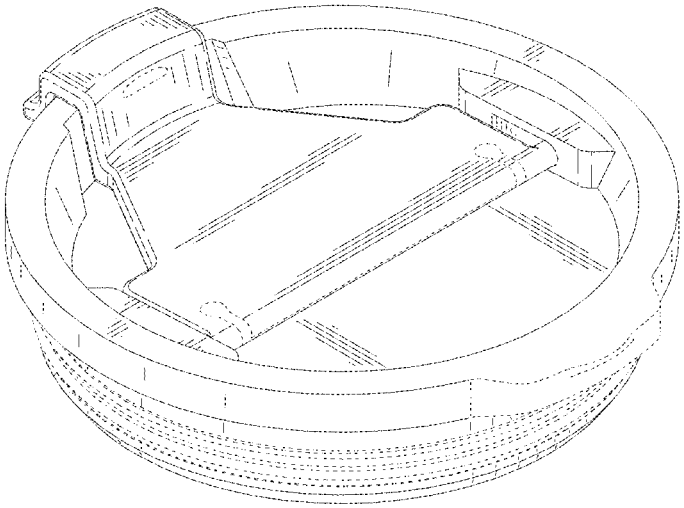
FIG. 35 is a structural schematic diagram of the container lid of FIG. 33 from another view angle.
Figure 36:
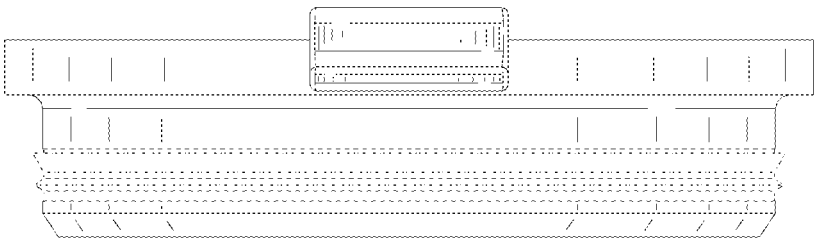
FIG. 36 is a front view of the container lid in FIG. 33.
Figure 37:
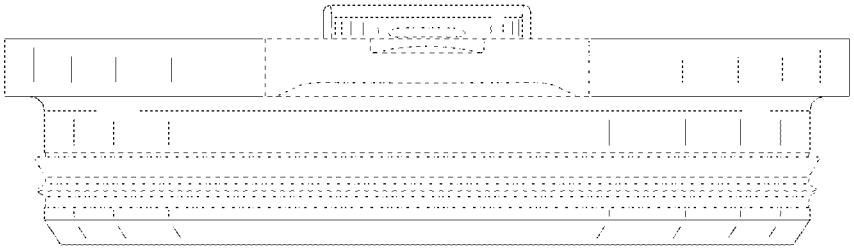
FIG. 37 is a rear view of the container lid in FIG. 33.
Figure 38:
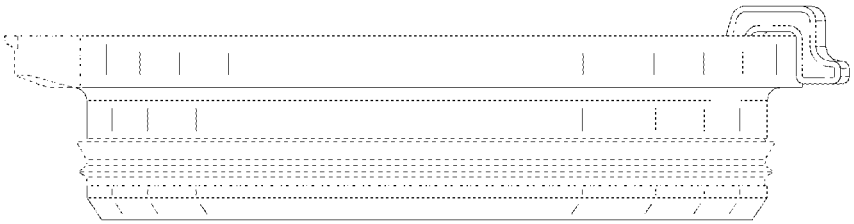
FIG. 38 is a left view of the container lid in FIG. 33.
Figure 39:
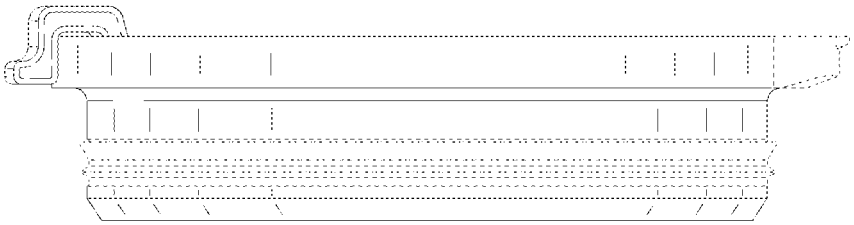
FIG. 39 is a right view of the container lid in FIG. 33.
Figure 40:
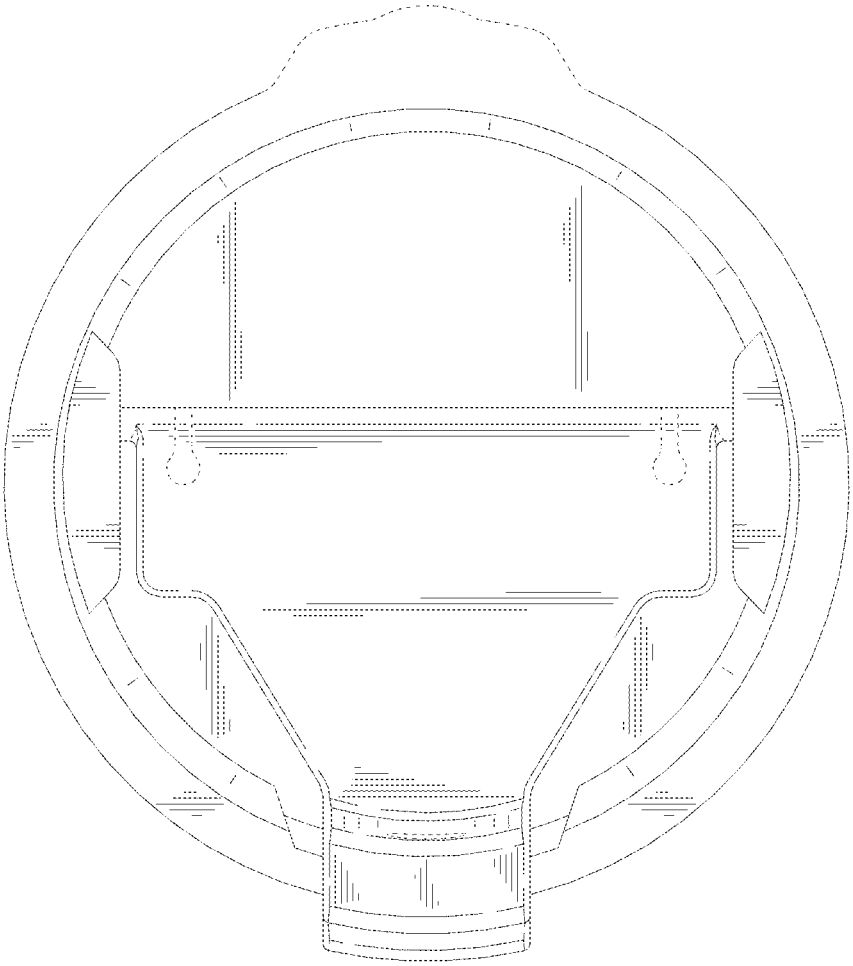
FIG. 40 is a top view of the container lid in FIG. 33.
Figure 41:
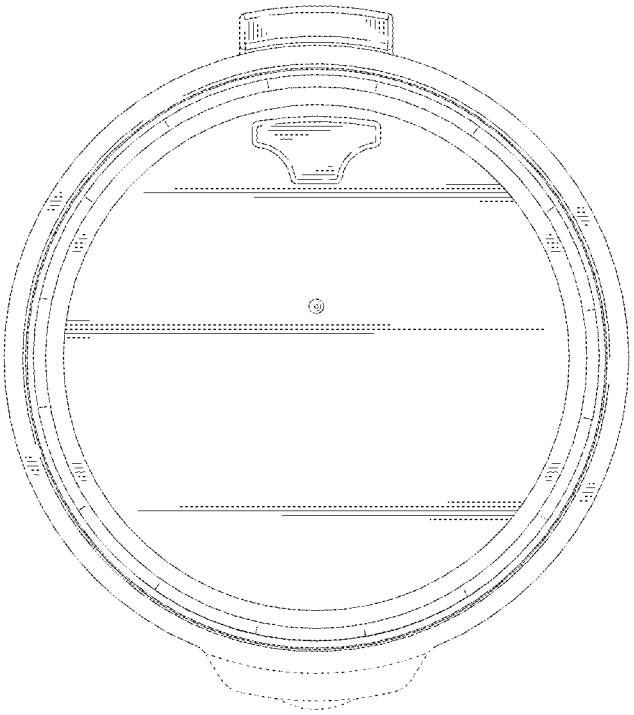
FIG. 41 is a bottom view of the container lid in FIG. 33.

Referring to FIG. 21 to FIG. 29, and FIG. 33 to FIG. 42, the fifth embodiment of the present disclosure can provide a container lid 100, which can match with a container body (such as a cup body) to form a container such as a cup with a lid. Referring to FIG. 31 to FIG. 33, the container lid 100 can include a lid body 10 provided with a liquid outlet 101 and an outlet lid 20. The outlet lid 20 can be detachably connected to the lid body 10, and configured to open or seal the liquid outlet 101 of the lid body 10. When the outlet lid 20 pivots relative to the lid body 10, the container lid 100 can be switched between the closed state and the opened state, and the opened state can include a detachable opened state. It could be understood that the liquid outlet 101 could be an opening extending through the lid body 10. Thus, when the container lid 100 covers on the container body and the outlet lid 20 is not sealed on the liquid outlet, a liquid (such as a drink) in the container body can flow out from the liquid outlet 101 for the user to drink.

It should be noted that the outlet lid 20 of the present disclosure can be detachably pivotally connected to the lid body 10. Thus, whether the outlet lid 20 is sealed on the liquid outlet 101, or the outlet lid 20 is not sealed on the liquid outlet 101, the outlet lid 20 can be pivotally connected to the lid body 10, so as to prevent the outlet lid 20 from missing. At the same time, when the container lid 100 is in the detachable opened state, the outlet lid 20 can be detached from the lid body 10, so as to wash the lid body and the outlet lid 20 conveniently.

Figure 22:
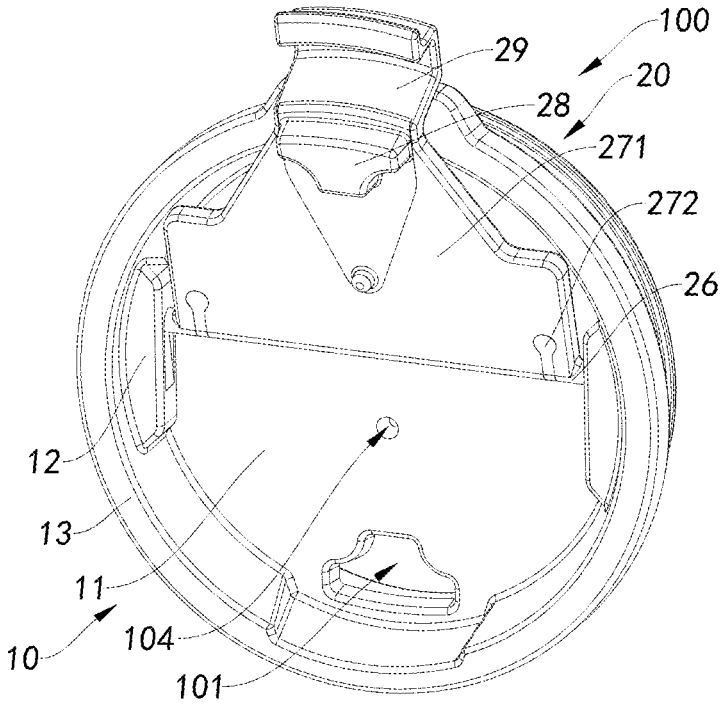
FIG. 22 is a stereoscopic diagram of the container lid in FIG. 21 in a fixed opened state.
Figure 23:
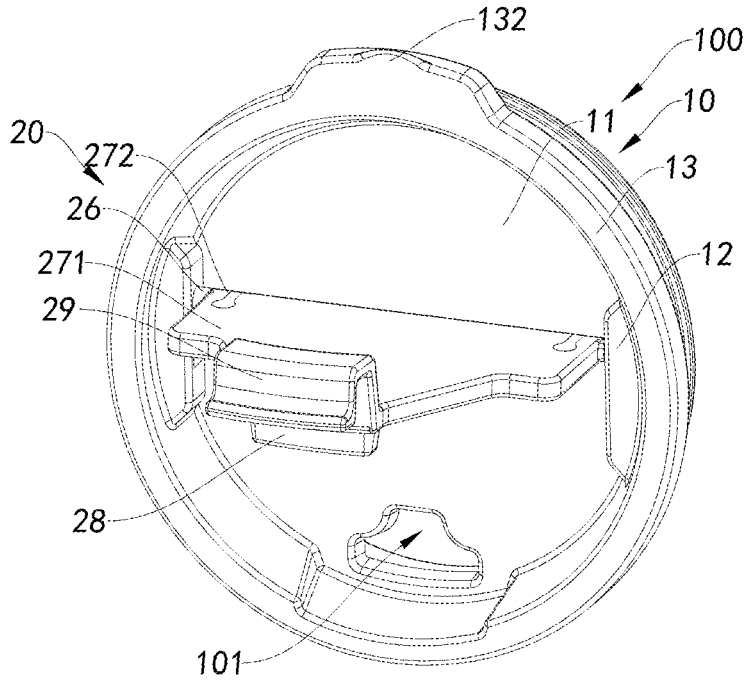
FIG. 23 is a stereoscopic diagram of the container lid in FIG. 21 in a detachable opened state.
Figure 42:
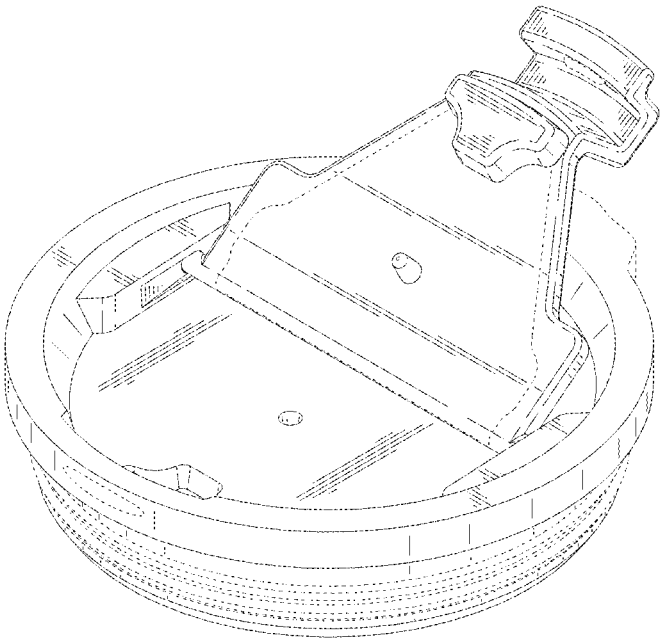
FIG. 42 is a schematic diagram of the container lid in FIG. 33 in a used state.

In some embodiments, referring to FIG. 21, FIG. 25 and FIG. 33 to FIG. 41, when the outlet lid 20 is pivoted to make the container lid 100 turn to the closed state, the outlet lid 20 can move towards and cover the liquid outlet 101, so as to prevent the liquid from flowing out of the liquid outlet 101. Thus the user can store or carry the container more conveniently. Referring to FIG. 22, FIG. 23 and FIG. 42, when the outlet lid 20 is pivoted to make the container lid 100 turn to the opened state, the outlet lid 20 moves away to open the liquid outlet 101. At the same time, referring to FIG. 23 and FIG. 29, when the outlet lid 20 is pivoted to make the container lid 100 switch to the detachable opened state, the outlet lid 20 can be rotated to separate from the lid body 10. In other words, when the outlet lid 20 is rotated around the pivot relative to the lid body, the container lid 100 can be switched between the closed state and the opened state. When the container lid 100 is in the detachable opened state of the opened state, the outlet lid 20 can be detached from the lid body by pivoting around a non-pivot pin relative to the lid body 10, so as to separate the outlet lid 20 from the lid body 10 and wash the outlet lid 20 and the lid body 10 conveniently.

Figure 24A:
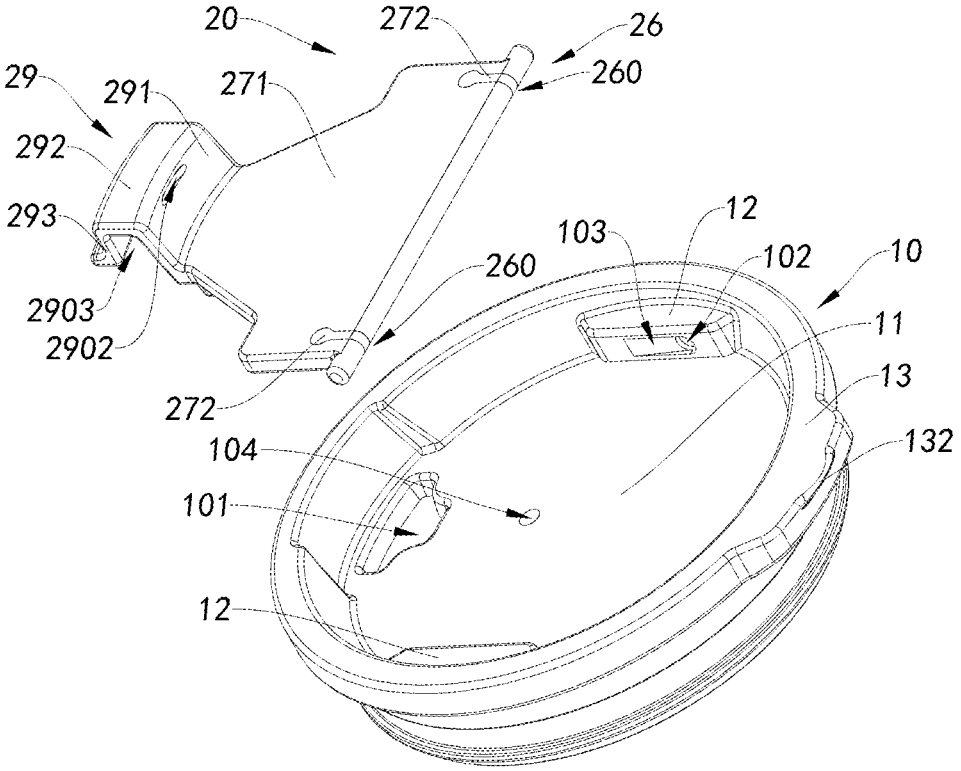
FIG. 24A and FIG. 24B are explosive views of the container lid in FIG. 21, respectively.
Figure 24B:
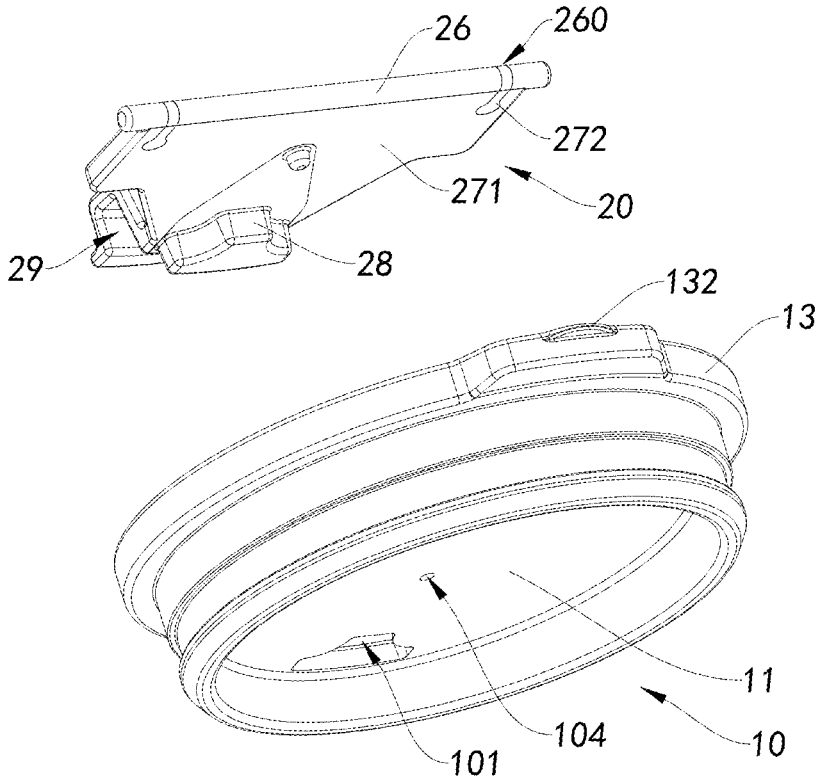
Figure 29:
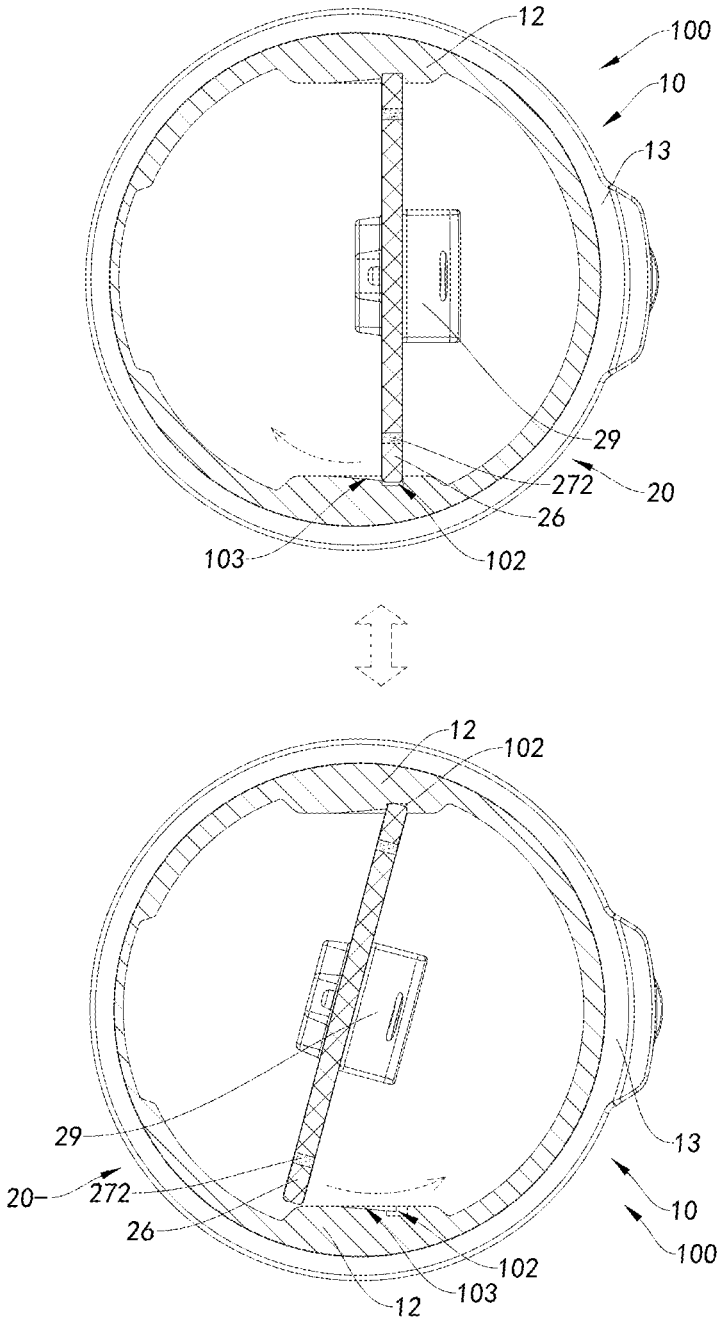
FIG. 29 is a schematic diagram of a process of detaching the container lid in FIG. 21.

In some embodiments, referring to FIG. 24A, FIG. 24B and FIG. 29, the outlet lid 20 can include a pivot portion 26 connected to the lid body 10 and a sealing cover 271 extending from the pivot portion 26 along a radial direction of a cross section of the lid body 10. When the sealing cover 271 of the outlet lid 20 pivots around the pivot portion 26, the container lid 100 can switch between the closed state and the detachable opened state. When the container lid 100 is in the detachable opened state, the pivot portion 26 of the outlet lid 20 is rotated around an end of the pivot portion 26 to separate the outlet lid 20 from the lid body 10.

Accordingly, the lid body 10 can be further provided with a pair of pivot grooves 102 and a detaching groove 103. The pair of pivot grooves 102 can be configured to match with two ends of the pivot portion 26, and the detaching groove 103 can be in communication with the pair of pivot grooves 102. The two ends of the pivot portion 26 of the outlet lid 20 are inserted in and pivotally connected to the pair of pivot grooves 102 of the lid body 10 respectively. When the pivot portion 26 of the outlet lid 20 is rotated around the end of the pivot portion 26, another end of the pivot portion 26 of the outlet lid 20 can slide out of the pivot groove 102 along the detaching groove 103, so as to easily detach the outlet lid 20 from the lid body 10. Similarly, the pivot portion 26 of the outlet lid 20 is reversely rotated around the end of the pivot portion 26, and another end of the pivot portion 26 of the outlet lid 20 can slide into the pivot groove 102 along the detaching groove 103, so as to easily assemble the outlet lid 20 to the lid body 10.

In some embodiments, the sealing cover 271 of the outlet lid 20 can be integrally formed with the pivot portion 26, and extend from the pivot portion 26, so as to define an integral outlet lid, which simplifies a structure of the outlet lid and facilitates cleaning the outlet lid.

Figure 26:
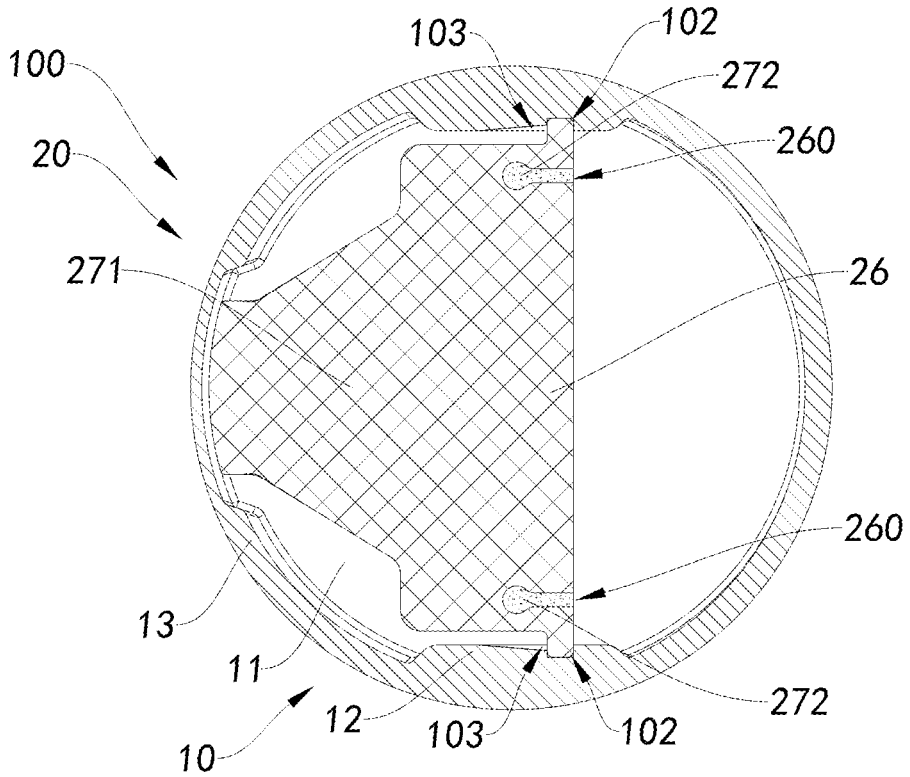
FIG. 26 is a cross-sectional view of the container lid in FIG. 21 in the closed state.

In some embodiments, referring to FIG. 24A and FIG. 26, the pivot portion 26 of the outlet lid 20 in the present disclosure can be provided with a deforming groove 260, to improve a deformability of the pivot portion 26. Thus, when the pivot portion 26 of the outlet lid is rotated around an end of the pivot portion 26, the pivot portion 26 can slightly deform along an axis of the pivot portion 26, so as to make another end of the pivot portion 26 slide out of the detaching groove 103, thereby disassembling the container lid 100. In addition, after reversely rotate the outlet lid 20 to assemble the outlet lid 20 on the lid body 10, the pivot portion 26 can recover to an original length to ensure that the pivot portion 26 can be stably kept in the pivot groove 102, thereby preventing the pivot portion 26 from departing from the outlet lid 10 by accident. It could be understood that the detaching groove 103 can be regarded as the opening 22 in the present embodiment.

In some embodiments, the outlet lid 20 can further include a flexible member 272. The flexible member 272 can be accommodated in the deforming groove 260 of the pivot portion 26, so as to ensure smoothness of the outlet lid 20 while ensuring that the pivot portion 26 can have relatively great deformability. Therefore, dust and greasy dirt deposition in the deforming groove 260 can be avoided, and the outlet lid can be washed more conveniently.

Figure 25:
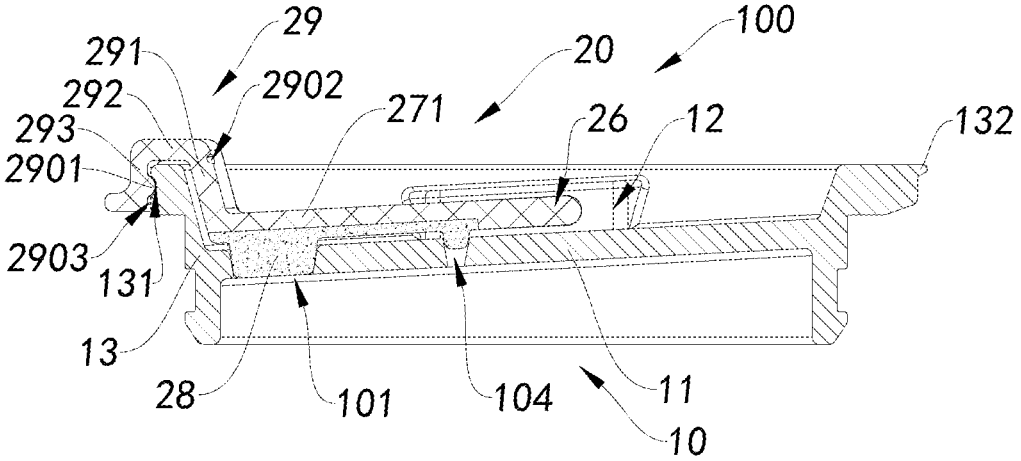
FIG. 25 is a longitudinal-sectional view of the container lid in FIG. 21 in the closed state.

In some embodiments, referring to FIG. 24B and FIG. 25, the outlet lid 20 can further include a sealing member 28. The sealing member 28 can be correspondingly disposed on the sealing cover 271. When the container lid 100 is in the closed state, the sealing member 28 can be disposed between the sealing cover 271 and the lid body 10, and configured to seal the liquid outlet 101 of the lid body 10.

It should be noted that a material of both the flexible member 272 and a material of the sealing member 28 in the present disclosure can be, but not limited to, flexible materials (such as silica gel). The flexible member 272 can maintain a deformability of the pivot portion 26 better, and the sealing member 28 can seal the liquid outlet 101 better.

In some embodiments, the sealing member 28 can include a protruding portion matched with the liquid outlet 101. Thus, when the container lid 100 is in the closed state, the protruding portion of the sealing member 28 can be inserted into the liquid outlet in interference, so as to improve sealing performance of the outlet lid 20.

Figure 27:
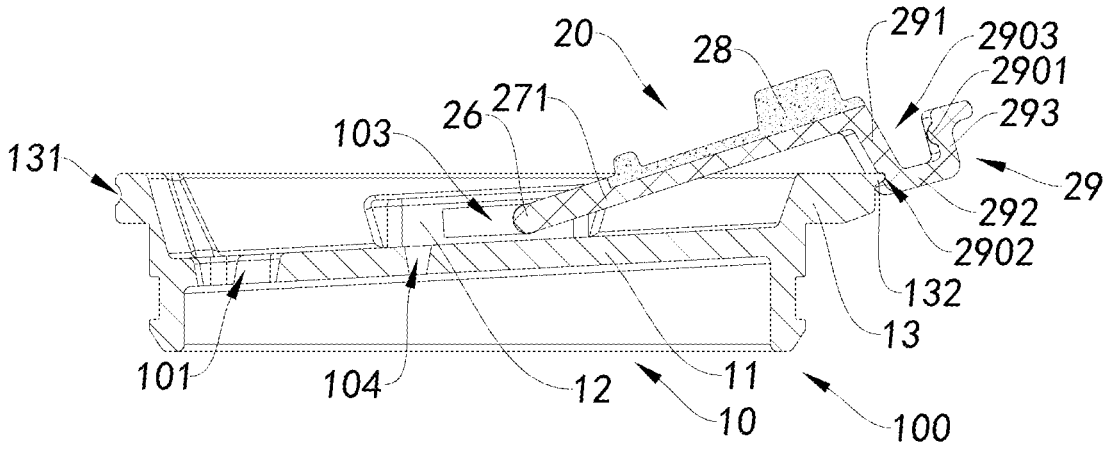
FIG. 27 is a longitudinal-sectional view of the container lid in FIG. 21 in the fixed opened state.
Figure 28:
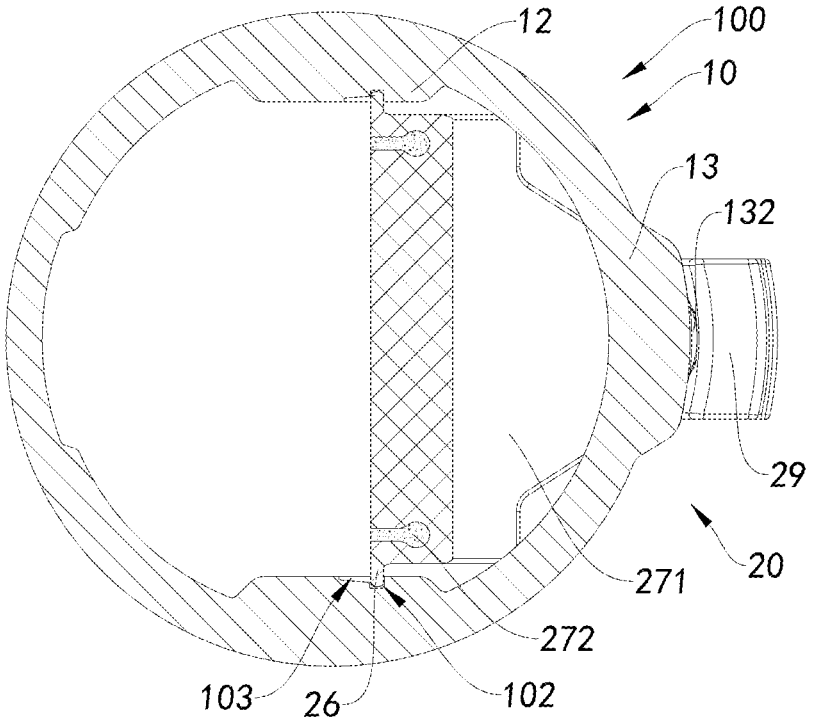
FIG. 28 is a cross-sectional view of the container lid in FIG. 21 in the fixed opened state.

In a lid body 10 of a container lid 100 in some embodiments of the present disclosure, referring to FIG. 26 to FIG. 28, a bottom surface of the detaching groove 103 obliquely extends from a groove bottom 102 of the pivot groove 102 towards a notch of the pivot groove 102, so as to lead the pivot portion 26 of the outlet lid 20 to depart from the pivot groove 102. In other words, a depth of the detaching groove 103 gradually decreases while extending towards the notch of the pivot groove 102, so that the depth of the detaching groove near the pivot groove 102 is greater than that of the detaching groove away from the pivot groove 102. It could be understood that the pivot groove 102 is generally deep enough to stably pivotally connected to both ends of the pivot portion 26 of the outlet lid 20, and the detaching groove 103 can provide a gradually shallow sliding channel for the pivot portion 26. Thus, when the container lid 100 is in the detachable opened state and the pivot portion of the outlet lid 20 is rotated, the pivot portion 26 can deform under the guidance of the detaching groove 103, so as to depart from the pivot portion 102 and be disassembled.

In some embodiments, the pair of detaching grooves 103 of the lid body 10 can match with the pair of pivot grooves 102, respectively, and bottom surfaces of the two detaching grooves 103 extend towards each other from the corresponding pivot grooves 102, respectively. In other words, a distance between the bottom surfaces of the two detaching groove 103 gradually decreases along a direction away from the pivot groove, so that a minimum distance between the bottom surfaces of the two detaching groove 103 can be smaller than a length of the pivot portion 26. Therefore, when an end of the pivot portion 26 of the outlet lid 20 is rotated around the other end of the pivot portion 26, the end of the pivot portion 26 can slide into the corresponding detaching groove 103, and the other end of the pivot portion 26 can still stay in the corresponding pivot groove 102. Thus, the end of the pivot portion 26 can slide out along the corresponding detaching groove 103 with a slight deformation, so that the outlet lid 20 can be disassembled with less labor. When the outlet lid 20 pivots around the pivot portion 26, since a minimum distance between the bottom surfaces of the two detaching groove 103 is smaller than a length of the pivot portion 26, two ends of the pivot portion 26 of the lid body 20 will not slide into the detaching groove 10 at the same time. Thus, when the outlet lid 20 is pivoted to switch a state of the container lid 100, the outlet lid 20 will not be detached from the lid body 10 by accident, and the outlet lid 20 can be disassembled from the lid body 10 by rotating the pivot portion 26 along a certain angle.

In some embodiment, a maximum distance between the bottom surfaces of the two detaching grooves 103 can be slightly smaller than a length of the pivot portion 26, so as to further improve the pivotal connection stability between the outlet lid 20 and the lid body 10. Therefore, when the lid body is pivoted relative to the outlet lid 20, the two ends of the pivot portion of the outlet lid 20 will not depart from the pivot groove 102 of the lid body 10.

In some embodiments, referring to FIG. 29, the detaching groove 103 of the lid body 10 can extends along a direction from the pivot groove 102 towards the liquid outlet 101, so that an end of the pivot portion 26 of the outlet lid 20 can slide out along the detaching groove 103 only when the end of the pivot portion 26 is rotated along the direction towards the liquid outlet 101.

Figure 21:
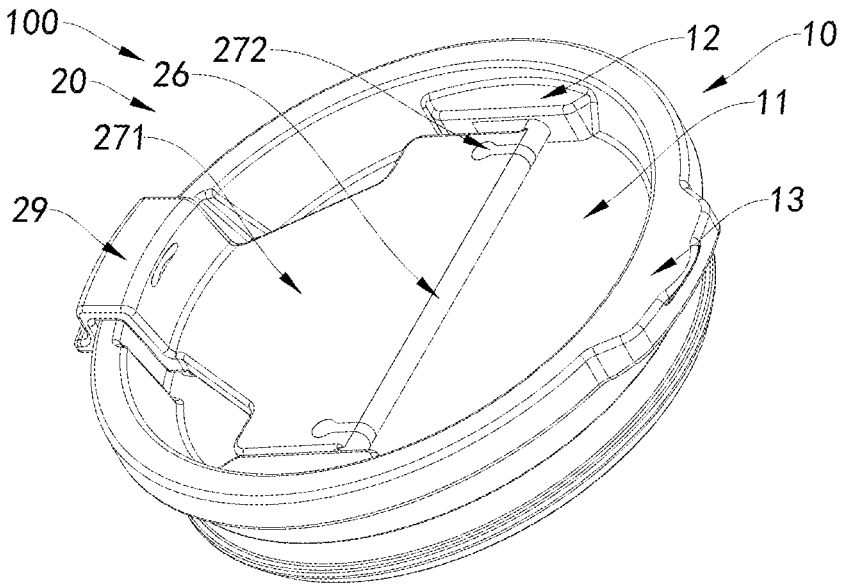
FIG. 21 is a stereoscopic diagram of a container lid of the fifth embodiment of the present disclosure in the closed state.

According to the embodiments above, referring to FIG. 21, FIG. 23 and FIG. 24A, the lid body 10 of the container lid 100 can include an opening portion that defines the liquid outlet 101, a pair of second pin joint portions 12 extending upwards from the opening portion, and a peripheral portion 13 surrounding the opening portion 11. An inner wall of the second pin joint 12 of the lid body 10 is capable of curving outwards to define the pivot groove 102 and the detaching groove 103. Therefore, when the outlet lid 20 is pivotally connected to the lid body 10, the outlet lid 20 can turn over around the pivot portion 26 above the lid body 10, so as to open or close the outlet lid 101 of the lid body 10.

It should be noted that, referring to FIG. 22, the opened state of the container lid 100 can further include a fixed opened state. That is, when the container lid 100 is in the fixed opened state, the outlet lid 20 of the container lid 100 can be releasable fixed to the lid body 10, so that the outlet lid 20 can be stably kept at a position away from the liquid outlet 101 of the lid body 10, thereby ensuring comfortable drink of the user. It should be understood that referring to FIG. 21 to FIG. 23, in the container lid 100 of the present disclosure, both the detachable opened state and the fixed opened state belong to the opened state, that is, the liquid outlet 101 of the lid body 10 are opened in the detachable opened state and the fixed opened state. The difference between the detachable opened state and the fixed opened state are: when the container lid 100 is in the detachable opened state, the outlet lid is movable relative to the lid body, so that the outlet lid can be pivoted; and when the container lid 100 is in the fixed opened state, the outlet lid 20 is fixed relative to the lid body 10, so that the user can comfortably drink a liquid. In other words, the detachable opened state in the present disclosure refers to a state between the closed state and a fixed opened state, the fixed opened state and the closed state are two extreme pivotal positions of the outlet lid 20 relative to the lid body; and, the detachable opened state is a middle pivotal position of the outlet lid 20 relative to the lid body 10.

In some embodiments, referring to FIG. 21 and FIG. 22, the outlet lid 20 of the container lid 100 can further include a clamping portion 29 extending out from the sealing cover 271. The clamping portion 29 of the outlet lid 20 can be configured to clamp the peripheral portion 13 of the lid body 10, so that the container lid 100 can be maintained in the closed state or the fixed opened state. In other words, when the container lid 100 is in the closed state, the clamping portion 29 of outlet lid 20 can be clamped to a position on the peripheral portion 13 of the lid body 10 near the liquid outlet 101, so as to improve sealing effect of the outlet lid 20, and prevent the outlet lid 20 from being propped out by pressure in the container, thereby avoiding a hot liquid in the container from leaking or rushing out. When the container lid 100 is in the fixed opened state, the clamping portion 29 of the outlet lid 20 can be clamped to a position on the peripheral portion 13 of the lid body 10 away from the liquid outlet 101, so as to prevent the outlet lid 20 from being covered on the liquid outlet 101 under an action of gravity, thereby ensuring comfortable drinking experience of the user.

Referring to FIG. 25 and FIG. 27, the peripheral portion 13 of the lid body 10 can be provided with a matching groove 131 at a position near the liquid outlet 101, and the peripheral portion 13 can be provided with a matching protrusion 132 at a position away from the liquid outlet 101. Accordingly, the clamping portion 29 of the outlet lid 20 can include a clamping protrusion 2901 matched with the matching groove 131 and a clamping groove 2902 matched with the matching protrusion 132. Therefore, when the container lid 100 is in the closed state, the clamping protrusion 2901 of the clamping portion 29 of the outlet lid 20 can be latched with the matching groove 131 of the peripheral portion 13; and when the container lid 100 is in the fixed open state, the clamping groove 2902 of the clamping portion 29 of the outlet lid 20 can be latched with the matching protrusion 132 of the peripheral portion 13. It could be understood that in other embodiments of the present disclosure, positions of the matching groove 131 and the matching protrusion 132 on the peripheral portion 13 can be replaced with each other. Accordingly, positions of the clamping protrusion 2901 and the clamping groove 2902 of clamping portion 29 on the outlet lid 20 can also be replaced with each other. Optionally, both positions on the peripheral portion 13 can be provided with two matching grooves 131 or two matching protrusions 132, and the clamping portion 29 can be provided with the two clamping protrusions 2901 or the two clamping grooves 2902, accordingly.

Optionally, referring to FIG. 25 and FIG. 27, the clamping portion 29 of the outlet lid 20 can include a first longitudinal sidewall 291 extending along a longitudinal direction of the sealing cover 271, a middle horizontal wall 292 extending along a horizontal direction from the first longitudinal sidewall 291 and a second longitudinal sidewall 293 extending along the longitudinal direction from the middle horizontal wall 292. The first longitudinal sidewall 291 of the clamping portion 29 and the second longitudinal sidewall 293 of the clamping portion 29 can be disposed at intervals, so as to define an accommodating groove 2903 between an outer surface of the first longitudinal sidewall 291 and an inner surface of the second longitudinal sidewall 293. The accommodating groove 2903 is configured to accommodate the peripheral portion 13 of the lid body 10. The clamping protrusion 2901 of the clamping portion 29 can be disposed at the inner surface of the second longitudinal sidewall 293, so as to be disposed in the accommodating groove 2903. The clamping groove 2902 of the clamping portion 29 can be disposed at the inner surface of the first longitudinal sidewall 291, so as to be disposed outside the accommodating groove 2903. Accordingly, both the matching groove 131 of the lid body 10 and the matching protrusion 132 of the lid body 10 can be disposed on an outer surface of the peripheral portion 13.

Therefore, referring to FIG. 25, when the container lid 100 is in the closed state, the peripheral portion 13 of the lid body 10 can be partially accommodated in the accommodating groove 2903 of the clamping portion 29, so that the outer surface of the first longitudinal sidewall 291 and the inner surface of the second longitudinal sidewall 293 of the clamping portion 29 can abut against the inner surface and the outer surface of the peripheral portion 19, respectively. Thus, the pivot portion 26 of the outlet lid 20 will not suffer from a pulling force caused by the peripheral portion 13 of the lid body 10 while ensuring that the clamping protrusion 2901 is stably clamped to the matching groove 131, so that the pivot portion 26 of the outlet lid 20 will not slide into the detaching groove 103, so as to keep the container lid 100 in the closed state. Referring to FIG. 27, when the container lid 100 is in the fixed opened state, the matching protrusion 132 on the outer surface of the first longitudinal sidewall 291 of the clamping portion 29 can abut against the outer surface of the peripheral portion 13, so that the peripheral portion 13 of the lid body 10 can apply an outwards force on the clamping portion 29 of the outlet lid 20, so as to ensure that the clamping groove 2902 can be stably latched on the matching protrusion 132. At the same time, the pivot portion 26 of the outlet lid 20 can apply a pulling force away from the detaching groove 103 on the second pin joint portion 12 of the lid body 10, which can ensure that the pivot portion 26 of the outlet lid 20 will not slide into the detaching groove 102 and the container lid 100 can be stably kept in the fixed opened state.

It could be noted that the inner side and the outer side of the lid body is defined according to a geometric center of the lid body 10. For example, a surface away from the geometric center of the lid body 10 is defined as an outer surface, and a surface near the geometric center of the lid body 10 is defined as an inner surface. It could be understood that in some embodiments of the present disclosure, the clamping protrusion 2901 of the clamping portion 29 can be disposed on the outer surface of first longitudinal sidewall 291, so as to be disposed in the accommodating groove 2903; and, correspondingly, the matching groove 131 in the lid body 10 can be located on the inner surface of the peripheral portion 13, which can still achieve the latching effect of the container lid 100 in the closed state.

In the embodiments above of the present disclosure, referring to FIG. 22 and FIG. 23, the liquid outlet 101 of the lid body 10 can be disposed at a position near the peripheral portion 13 on the opening portion 11, so that the user can drink the liquid in the container through the liquid outlet 101.

In some embodiments, referring to FIG. 22 and FIG. 24A, the lid body 10 can be further provided with an air hole 104 extending through the opening portion 11. Therefore, when the container lid 100 is in the closed state, the outlet lid 20 can simultaneously cover the liquid outlet 101 and the air hole 104. When the container lid 100 is in the opened state, the liquid outlet 101 and the air hole 104 can be simultaneously opened. At this time, in a process the user drinks the liquid via the liquid outlet 101, and the air can enter the container via the air hole 104 to keep a pressure in the container constant, thereby ensuring that the liquid can flow out from the liquid outlet 101.

In some embodiments, the air hole 104 can be located at a position away from the peripheral portion 13 on the opening portion 11, so as to prevent the user's lips from sealing the air hole 104 while drinking the liquid via the liquid outlet 101.

In some embodiments, referring to FIG. 25, the sealing member 28 of the outlet lid 20 can simultaneously seal the liquid outlet 101 and the air hole 104 of the lid body. For example, the sealing member 28 can be further provided with a protruding portion matching with the air hole 104. When the container lid 100 is in the closed state, the protruding portion of the sealing member 28 can be inserted in to the air hole 104 in interference, so as to further improve the sealing performance of the outlet lid 20.

It should be noted that in some embodiments of the present disclosure, although a deformability of the pivot portion 26 can be improved by providing the deforming groove 260 on the pivot portion 26 of the outlet lid 20, the outlet lid 20 of the container lid 100 can be without deformability in some embodiments. The same effect can be achieved with other elastic members.

Figure 30:
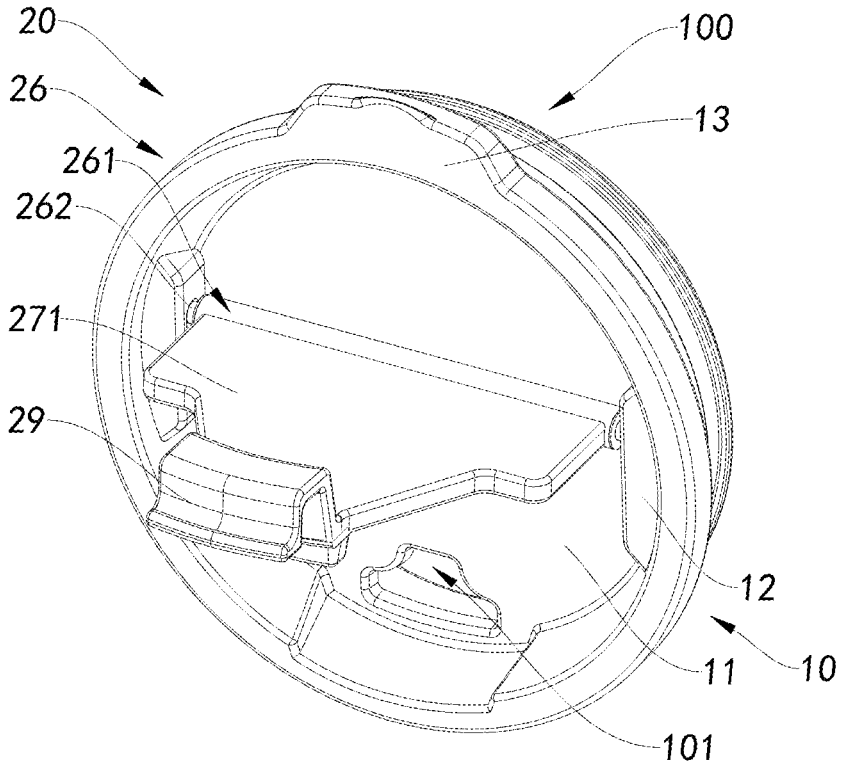
FIG. 30 is a stereoscopic diagram of the container lid in a sixth embodiment of the present disclosure.

For example, referring to FIG. 30 to FIG. 32, a container lid 100 of some embodiments of the present disclosure is provided, which is denoted as the sixth embodiment. Compared with the fifth embodiment, the container lid 100 in the sixth embodiment can include the following differences: the pivot portion 26 of the liquid outlet 20 can include a pair of pivot chambers 261 connected to the sealing cover 271, a pair of pivot pins 262 movable disposed in the pair of pivot chambers 261, and a pair of elastic members 263 disposed between inner walls of the pair of pivot chambers 261 and the pair of pivot pins 262, respectively. Each of the pair of pivot pins 262 can be capable of retractably extending out of the pivot chamber 261 to insert into the pair of pivot grooves 102 of the lid body 10 under action of the elastic member 263, so as to achieve the pivotal connection between the outlet lid 20 and the lid body 10.

Therefore, when the pivot pin 262 extends out of the pivot chamber 261 under the action of the elastic member 263, the pivot pin 262 can be inserted in the pivot groove 102 of the lid body 10 to achieve the pivotal connection between the pivot portion 26 of the outlet lid 20 and the second pin joint portion 12 of the lid body 10. When the outlet lid 20 is rotated relative to the lid body 10, the pivot pin 262 of the pivot portion 26 can be extruded by a groove bottom of the detaching groove 103 of the lid body 10, so that the pivot pin 262 of the pivot portion 26 will retract into the pivot chamber 261 and slide out of the detaching groove 103. At the same time, the elastic member 263 can store an elastic potential energy to recover after the external force is left, so that the pivot pin 262 can extend out of the pivot chamber 261 to form the pivot pin.

It should be noted that referring to FIG. 31 and FIG. 32, the elastic member of 263 in the present disclosure can be a compressing spring. An end of the compressing spring can abut against the pivot pin 262, and the other end of the compressing spring can abut against the bottom surface of the pivot chamber 261. Therefore, when the pivot pin 262 is compressed in the pivot chamber 261 to disassemble the outlet lid 20, the compressing spring is compressed to store an elastic potential energy; and when a force applied on the pivot pin 262 is released, the compressing spring can recover automatically to push the pivot pin 262 to extend out of the pivot chamber 261, so that the pivot pin 262 can be inserted in the pivot groove 102 of the lid body 10, thereby achieving pivotal connection between the outlet lid 20 and the lid body 10.

It could be noted that in some embodiments of the present disclosure, both ends of the pivot portion 26 can be provided with a pivot chamber having a notch.

Correspondingly, when the pivot pin 262 can be fixed to the lid body 10, the pivot pin can be departed from the notch of the pivot chamber by rotating the pivot portion 26 while the outlet lid is pivotally connected to the lid body 10. Thus the pivot pin can be conveniently detached, which is not repeated herein.

It should be noted that in another aspect of the present disclosure, an embodiment of the present disclosure can further provide a container (not shown in the figures), which can include the container lid 100 and the container body. The container lid 100 can be covered on an opening of the container body to form a container with a lid. It could be understood that the container body is not limited to a cup body, a bottle body, a box body, a barrel body, etc., as long as the container include a chamber having an opening, which is not repeated herein.

The container lid and the container of the present disclosure can overcome defects such as difficult to clean and hard to remove deposited dirt of conventional container lids. An outlet lid of the present container is detachably connected to the lid body. The outlet lid can switch the container lid between a detachable opened state and a closed state by means of pivoting, and can further be disassembled from the lid body by means of pivoting, so as to facilitate adequate cleaning of the outlet lid and the lid body at any time, especially cleaning deposited dirt in fine positions of the outlet lid or the lid body. Therefore, the container can be used more conveniently, and more sanitary. In addition, the user can assemble the outlet lid on the lid body or disassemble the outlet lid from the lid body with a single hand, and the assemble process and the disassemble process are convenient.

Furthermore, in another aspect of the present disclosure, an embodiment of the present disclosure can further provide a method for using the container lid, including: pivoting the outlet lid relative to the lid body to make the container lid switch between the closed state and the detachable opened state; and when the container lid is in the detachable opened state, rotating the pivot portion of the outlet lid to separate the outlet lid from the lid body.

The present disclosure can further provide a container (not shown in the figures), which includes a container body and the container lid 100. The container body can be detachably connected to the container lid 100. The container body can be any one selected from a group consisting of a cup body, a bottle body, a box body, and a barrel body, and a size and shape of the container body is not limited herein.

The container lid and the container of the present disclosure can overcome defects such as difficult to clean and hard to remove deposited dirt of conventional container lids. An outlet lid of the present container can switch the container lid between an opened state and a closed state. In addition, the outlet lid can be detached from the lid body, so as to facilitate adequate cleaning of the outlet lid and the lid body at any time, especially cleaning deposited dirt in fine positions of the outlet lid or the lid body. Therefore, the container can be used more conveniently, and more sanitary.

The technical features of the above-described embodiments may be combined in any combination. For the sake of brevity of description, not all possible combinations of the technical features in the above embodiments are described. However, as long as there is no contradiction between the combinations of these technical features, all should be considered as within the scope of this disclosure.

The skilled in the art may understand that the above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

I claim:

1. A container lid, comprising a lid body and an outlet lid, wherein the lid body is provided with a liquid outlet; and the outlet lid is movably connected to the lid body, and configured to define a closed state, an opened state, and a detachable state of the container lid, when the container lid is in the closed state, the liquid outlet is closed, when the container lid is in the opened state, the liquid outlet is opened, and when the container lid is in the detachable state, the outlet lid is separated from the lid body, the lid body is provided with a first preset path and a second preset path, the outlet lid is capable of switching between the first preset path and the second preset path;

the outlet lid is capable of moving along the first preset path to make the container lid switch between the closed state and the opened state;

the outlet lid is capable of moving along the second preset path to make the container lid switch between the closed state and the detachable state or between the opened state and the detachable state, the first preset path comprises a sliding channel, the second preset path comprises an opening, the sliding channel is in communication with the opening, the container lid further comprises a sliding block fixed to the outlet lid and slidably matched with the sliding channel, and a size of the sliding block matches with a size of the opening; and the sliding channel is configured to lead the outlet lid to move along a surface of the lid body, and the opening is configured for allowing the outlet lid to be disassembled from the lid body.

2. The container lid of claim 1, wherein the sliding block is fixed on a side of the outlet lid near the lid body, the sliding block comprises a first end near the outlet lid and a second end away from the outlet lid, and a size of the first end along a width direction of the sliding channel is smaller than a size of the second end along the width direction of the sliding channel; the sliding channel comprises a first inner wall and a second inner wall opposite to the first inner wall along the width direction thereof; and a projection of the sliding block on a plane perpendicular to the first preset path is substantially the same with that of the first inner wall and second inner wall on the plane perpendicular to the first preset path, and the first inner wall and/or the second inner wall are configured to limit the sliding block to prevent from departing from the sliding channel.

3. The container lid of claim 2, wherein the projection of the sliding block on the plane perpendicular to the first preset path is L-shaped.

* * * * *